US006433489B1

(12) United States Patent
Tanaka et al.

(10) Patent No.: US 6,433,489 B1
(45) Date of Patent: Aug. 13, 2002

(54) PLASMA DISPLAY PANEL AND METHOD FOR MANUFACTURING THE SAME

(75) Inventors: Hiroyoshi Tanaka, Kyoto; Masaki Aoki, Minoo; Junichi Hibino, Neyagawa; Yuusuke Takada, Katano; Nobuaki Nagao, Uji; Isamu Inoue, Neyagawa; Shinya Hujiwara; Koji Funami, both of Kyoto; Toshiyuki Okada, Toyonaka, all of (JP)

(73) Assignee: Matsushita Electric Industrial Co., Ltd., Osaka-Fu (JP)

( * ) Notice: Subject to any disclaimer, the term of this patent is extended or adjusted under 35 U.S.C. 154(b) by 0 days.

(21) Appl. No.: 09/673,960

(22) PCT Filed: Apr. 28, 1999

(86) PCT No.: PCT/JP99/02278

§ 371 (c)(1),
(2), (4) Date: Oct. 24, 2000

(87) PCT Pub. No.: WO99/56300

PCT Pub. Date: Nov. 4, 1999

(30) Foreign Application Priority Data

| | | |
|---|---|---|
| Apr. 28, 1998 | (JP) | 10-118330 |
| Apr. 28, 1998 | (JP) | 10-118331 |
| Apr. 28, 1998 | (JP) | 10-118332 |
| Apr. 28, 1998 | (JP) | 10-118333 |
| Apr. 28, 1998 | (JP) | 10-118342 |
| Oct. 2, 1998 | (JP) | 10-280813 |
| Apr. 5, 1999 | (JP) | 11-108420 |

(51) Int. Cl.[7] ..... G09G 3/10

(52) U.S. Cl. ..... 315/169.4; 313/584; 445/24; 445/25

(58) Field of Search ..... 315/169.4, 169.1; 313/582, 584, 311; 430/22, 30, 394; 445/24, 25

(56) References Cited

U.S. PATENT DOCUMENTS

| | | | | |
|---|---|---|---|---|
| 5,536,466 | A | 7/1996 | Ogawa et al. | 264/400 |
| 5,868,952 | A | 2/1999 | Hatakeyama et al. | 216/66 |
| 5,876,884 | A * | 3/1999 | Maeda et al. | 430/22 |
| 5,952,782 | A * | 9/1999 | Nanto et al. | 313/582 |
| 5,982,095 | A * | 11/1999 | Jin et al. | 313/582 |
| 6,242,859 | B1 * | 6/2001 | Betsui et al. | 313/584 |

FOREIGN PATENT DOCUMENTS

| | | |
|---|---|---|
| JP | 50126194 | 10/1975 |
| JP | 60230335 | 11/1985 |
| JP | 3077234 | 4/1991 |
| JP | 3250526 | 11/1991 |
| JP | 4245141 | 9/1992 |
| JP | 5114362 | 5/1993 |
| JP | 5303916 | 11/1993 |
| JP | 675250 | 3/1994 |
| JP | 7320637 | 12/1995 |
| JP | 817923 | 1/1996 |
| JP | 8264511 | 10/1996 |
| JP | 9126724 | 5/1997 |
| JP | 9307217 | 11/1997 |

* cited by examiner

*Primary Examiner*—Haissa Philogene
(74) *Attorney, Agent, or Firm*—Price and Gess

(57) ABSTRACT

A plasma display (PDP) manufacturing method and display panel includes a display electrode forming step of forming a plurality of pairs of display electrodes in parallel lines on a main surface of a first plate, and a plate sealing step of aligning the main surface of the first plate with a main surface of a second plate, and sealing the first and second plates together. The display electrodes are formed by coating the main surface of the first plate with display electrode material, and performing laser ablation on parts of the display electrode material, while the remaining parts of the display electrode material form the display electrodes.

24 Claims, 13 Drawing Sheets

PLASMA DISPLAY PANEL AND METHOD FOR MANUFACTURING THE SAME

TECHNICAL FIELD

This invention relates to a plasma display panel, and a manufacturing method for the same.

BACKGROUND ART

Large screen display devices with high picture quality, such as that produced by high definition television (HDTV), have recently become the focus of much expectation. As a result, research and development of display devices such as cathode ray tubes (CRTs), liquid crystal displays (LCDs), and plasma display panels (PDPs) is taking place. These various types of display devices each have the following characteristics.

CRTs have excellent resolution and picture quality, and are widely used in conventional televisions and the like. The large increases in depth and weight required to produce a large screen CRT, however, are problematic, and solving this difficulty is crucial for the development of such CRTs. Due to this problem, it is believed to be difficult to produce a CRT with a large screen of more than 40 inches.

LCDs, on the other hand, use less electricity than CRTs, and are extremely light and slim. Nowadays, LCDs are being increasingly used as computer monitors. However, the structure of a typical LCD, which uses a thin film transistor (TFT) screen or similar, is extremely intricate, and this means that manufacture of such a device requires a plurality of complicated processes. As a result, manufacturing yield decreases as screen size is increased. This means that it is currently considered difficult to manufacture an LCD with a screen of more than 20 inches.

In contrast to CRTs and LCDs, PDPs have the advantage of being able to realize a lightweight display with a large screen, and in addition employ a driving method in which the PDP itself emits light to produce a screen display. As a result, in the current search for the next generation of displays, research and development of large screen PDPs is being pursued particularly aggressively, and products with screens of more than 50 inches are being developed.

In a PDP, a glass substrate, on which a plurality of pairs of display electrodes and a plurality of barrier ribs are arranged in a stripe formation, is placed in opposition to another glass substrate. Phosphors in each of the three colors red, green and blue are applied to the spaces between the barrier ribs. The two glass substrates are then sealed together so as to be airtight, and a discharge gas enclosed in the discharge space between the barrier ribs and the two glass substrates. Discharge is produced by ultraviolet light generated by the discharge gas, thereby causing the phosphors to emit light. PDPs such as this one can be divided into two types, direct current (DC) and alternating current (AC), according to the driving method used. AC PDPs are thought to be more suitable for producing a large screen device, and thus are the most common type of PDP.

However, current specifications for HDTV include a 1920×1080 pixel array, and a dot pitch of 0.16 mm×0.48 mm for 42-inch class screens. Consequently, the area occupied by one cell is as little as 0.077 $mm^2$, which is seven to eight times smaller than the size specified by the NTSC (National Television System Committee) standard for televisions in the same 42-inch class, and the number of scanning lines is almost three times as great as that specified in the NTSC standard. For these reasons, the manufacturing processes required to produce PDPs for HDTV use are of higher precision than those required to produce a television complying with the NTSC standard.

Consequently, the plurality of pairs of display electrodes in a PDP have to be set at intervals smaller than those in televisions compliant with the NTSC standard.

However, this creates certain problems when manufacturing the PDP. The plurality of pairs of electrodes are generally manufactured using a method disclosed in Japanese Laid-Open Patent 9-35628. The actual procedure for manufacturing electrodes using such a method is as follows. First, a transparent conductive film formed from indium tin oxide (ITO) or tin oxide ($SnO_2$), and a metal conductive film formed from three layers of chromium, copper and chromium (Cr—Cu—Cr) are successively formed on the surface of a front glass substrate using sputtering or a similar method. Following this, photolithography is used to process the conductive film so that the electrodes have a uniform shape. Photolithography is performed by repeating processes in which a photoresist is applied, and patterning and etching performed. Consequently, a large number of process steps are used, and the operation tends to take a long time. Furthermore, unwanted erosion caused by the etching solution, and slipping of the mask used for patterning are more likely to occur as the processes are repeated, making it difficult to preserve the same level of precision throughout the entire procedure. These problems are a particular obstacle when manufacturing the intricately-formed plurality of pairs of display electrodes used for HDTV.

There is still a great deal of room for improvement in current PDP manufacturing methods with regard to the technical problem of how to manufacture a plurality of pairs of display electrodes in a way that is faster and more precise than conventional methods.

DISCLOSURE OF THE INVENTION

The present invention was developed with the aim of solving the above problem. The object of the invention is to provide a PDP manufacturing method that incorporates laser ablation processing into the process used to manufacture the plurality of display electrodes and the like, thereby rationalizing the manufacturing process by shortening the time required, and manufacturing a PDP with a high yield.

The above object may be realized by a plasma display panel manufacturing method including a display electrode forming step of forming a plurality of pairs of display electrodes in parallel lines on a main surface of a first plate, and a plate sealing step of aligning the main surface of the first plate with a main surface of a second plate, and sealing the first and second plates together. Here, the plurality of pairs of display electrodes are formed in the display electrode forming step by coating the main surface of the first plate with display electrode material, and performing laser ablation on parts of the display electrode material. Remaining parts of the display electrode material form the display electrodes.

To be more specific, in the display electrode forming step, the display electrode material may contain transparent electrode material and metal electrode material, and the plurality of pairs of display electrodes may be formed using the following method. First, the main surface of the first plate is coated with the transparent electrode material, and laser ablation performed on the transparent electrode material to form transparent electrode parts. Then, at least surfaces of the transparent electrode parts are coated with the metal electrode material to form metal electrode parts that are in electrical contact with the transparent electrode parts.

Furthermore, in the display electrode forming step, the plurality of pairs of display electrodes may be formed in the following way. Laser ablation is performed on the transparent electrode material to form transparent electrode parts and alignment marks. Then, at least surfaces of the transparent electrode parts are coated with metal electrode material to form metal electrode parts, the alignment marks being used to align the metal electrode material with the transparent electrode parts.

If a plurality of pairs of display electrodes are manufactured in this way, laser processing can be performed simply by performing a laser ablation process, and then washing and drying processes. Therefore, the plurality of pairs of display electrodes can be formed more quickly and using a fraction of the number of processes required by a conventional photolithography method or the like. This reduces the generation of environmentally harmful waste solutions and the like, so that the use of the laser ablation process is likely to resolve various environmental problems. The laser ablation process can also be used to manufacture alignment marks, in addition to manufacturing the plurality of pairs of display electrodes.

Furthermore, a plasma display panel manufacturing method including a display electrode forming step and a plate sealing step may be used. Here, in the display electrode forming step, a plurality of pairs of display electrodes are formed in parallel lines on a main surface of a first plate. Then, in the plate sealing step, the main surface of the first plate is aligned with a main surface of a second plate on which a plurality of address electrodes have been arranged in parallel lines and the first and second plates sealed together, may be used. The plates are aligned so that the plurality of pairs of display electrodes intersect with the address electrodes. Here, the plurality of pairs of display electrodes may be formed in the display electrode forming step in the following way. The main surface of the first plate is coated with display electrode material, and laser ablation performed to vaporize parts of the display electrode material by applying a first laser beam and a second laser beam in parallel to the display electrode material. The remaining parts of the display electrode material form the display electrodes.

In addition, in the display electrode forming step, the plurality of pairs of display electrodes may be formed by performing laser ablation on parts of the display electrode material coating the main surface of the first plate by applying (1) a first laser beam of a first strength and (2) a second laser beam of a second strength different from the first strength.

By using laser beams of a first strength (or a first spot shape), and a second strength (or a second spot shape) to form the plurality of pairs of display electrodes, a plurality of pairs of display electrodes having gaps of different widths in various places can be formed, and the resistance value correction and precision repairs can be performed on the plurality of pairs of display electrodes. When this is combined with the above effects, the laser ablation process can be further streamlined.

Furthermore, a plasma display panel may be formed by aligning a main surface of a first plate, on which a plurality of pairs of display electrodes have been formed in parallel lines, with a main surface of a second plate, and sealing the first and second plates together. Here, alignment marks for performing plate alignment may be formed using laser ablation on at least one of the main surface of the first plate and the main surface of the second plate.

In addition, a plasma display panel may be formed by aligning a main surface of a first plate with a main surface of a second plate, and sealing the first and second plates together, a plurality of pairs of display electrodes having been formed in parallel lines on the main surface of the first plate. Each pair of display electrodes is formed from a transparent electrode part and a metal electrode part that are in electrical contact. Here, alignment marks for performing alignment of the transparent electrode parts and the metal electrode parts may be formed on the main surface of the first plate, the transparent and metal electrode parts having been formed by laser ablation.

Here, alignment marks may be provided on the main surface of the first plate for plate alignment, and for alignment of the transparent electrode parts with the metal alignment parts. Consequently, the main surfaces of the first and second plates and the transparent and metal electrodes can be precisely assembled, and a plasma display panel that makes full use of current technology can be produced.

BRIEF DESCRIPTION OF THE DRAWINGS

FIG. 3A shows a situation in which a transparent conductive film 50 covers the surface of the front glass substrate 21;

FIG. 3B shows a situation in which the transparent conductive film 50 is eliminated at either edge of the front glass substrate 21 in a direction x, in order to create electrode extension forming areas 210;

FIG. 3C shows a situation in which transparent electrode parts 221 and 231 are formed using laser ablation;

FIG. 3D shows a situation in which a metal conductive film 60 is applied;

FIG. 3E shows a situation in which metal electrode parts 222 and 232 are formed using etching (a wet photolithography process);

FIG. 4A is an external diagonal view of the gantry-type laser processing device 100;

FIG. 4B is a frontal enlargement of a laser torch 102;

FIG. 4C is a frontal view showing the shape of apertures 1031 and 1041 in the laser torch 102;

FIG. 5A is a diagonal view of part of the front glass substrate 21 showing a procedure for forming the transparent electrode parts 221 and 231 using a first laser beam and a second laser beam;

FIG. 5B is a front view of part of the front glass substrate 21 showing a process for forming gaps between a pair of transparent electrode parts 221 and 231;

FIG. 6A is a finished view of the transparent electrode parts 221 and 231 finished by the laser ablation process;

FIG. 6B shows a sequence of laser work relating to the laser ablation process;

FIG. 7A shows a situation in which a metal conductive film 60 is applied to the surface of the front glass substrate 21;

FIG. 7B shows a situation in which unnecessary parts of the metal conductive film 60 are eliminated by laser ablation;

FIG. 7C shows a situation in which the metal conductive film 60 is annealed by laser ablation;

FIG. 8A is a partial cross-section of the front glass substrate 21 showing a metal electrode part 232 before annealing has been performed;

FIG. 8B is a partial cross-section of the front glass substrate 21 showing the metal electrode part 232 after annealing has been performed;

FIG. 12A is a partial cross-section of the front glass substrate 21 showing edges 80*a* and 80*b* in cross-section;

FIG. 12B is a partial cross-section of the front glass substrate 21 showing edges 81*a* and 81*b* in cross-section;

FIG. 12C is a partial cross-section of the front glass substrate 21 showing edges 82*a* and 82*b* in cross-section;

FIG. 13A is a partial cross-section of the front glass substrate 21 showing a situation in which a photoresist 70 has been applied;

FIG. 13B is a partial cross-section of the front glass substrate 21 showing a situation in which the photoresist 70 has been exposed and an alkaline solution applied; and FIG. 13C is a partial cross-section of the front glass substrate 21 showing the formed edges 82*a* and 82*b* that have been formed, in cross-section.

BEST MODE FOR CARRYING OUT THE INVENTION

First Embodiment

Figure 1:
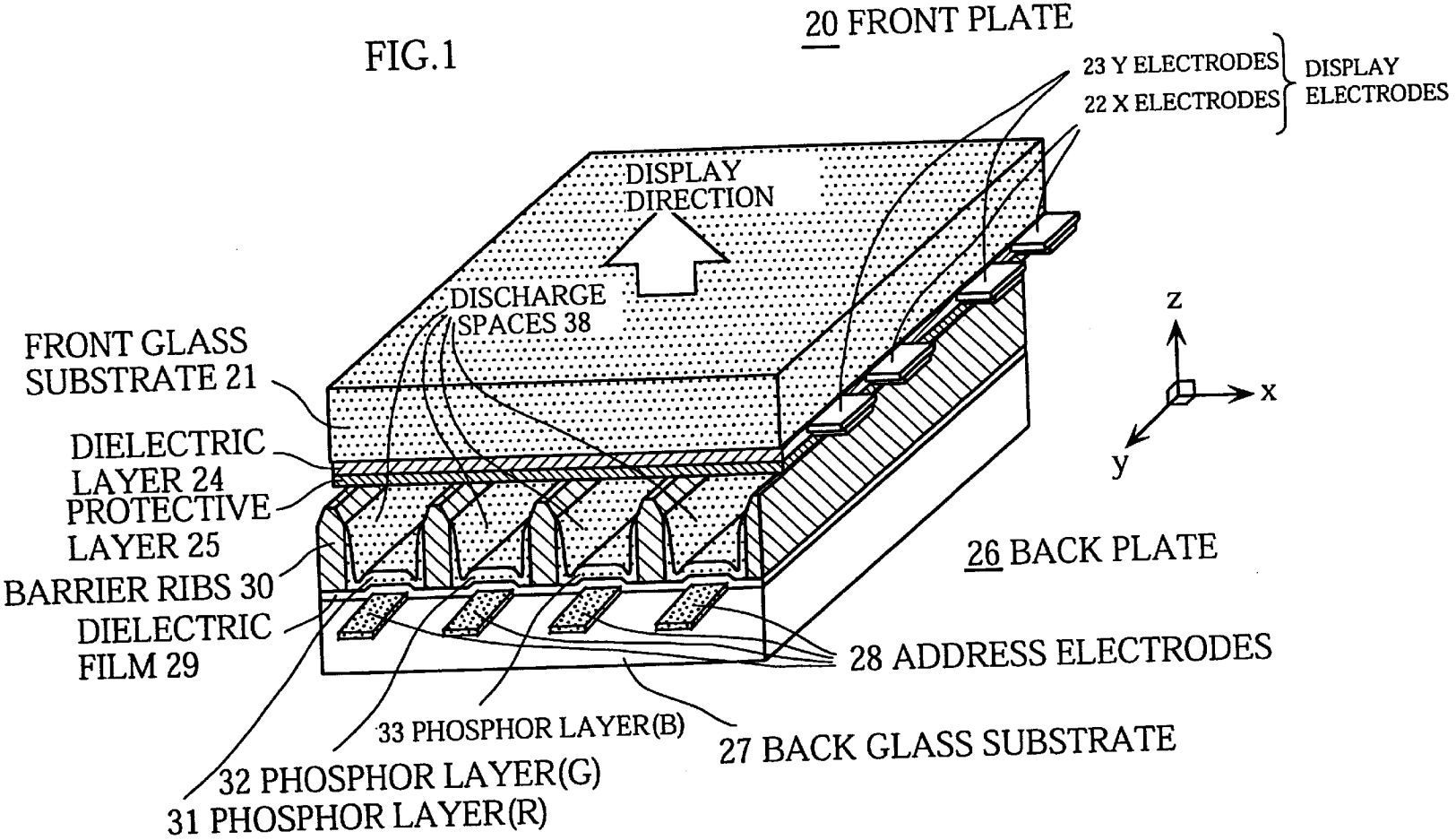
FIG. 1 shows a diagonal cross-section of part of a surface discharge AC PDP in a first embodiment.

FIG. 1 is a diagonal cross-section of part of a surface discharge alternating current (AC) PDP in a first embodiment. In the drawing, a z direction corresponds to the depth of the PDP, and an xy plane corresponds to a plane parallel with the PDP surface. As shown in the drawing, the structure of the PDP can be broadly divided into a front plate 20 and a back plate 26. In this and all relevant subsequent drawings (FIGS. 1 to 10), the x, y, and z directions are identical.

A front glass substrate 21 forming the base of the front plate 20 is composed from soda lime glass. A plurality of pairs of display electrodes 22 and 23 (each pair is formed from an X electrode 22 and a Y electrode 23) are arranged on the surface of the front glass substrate 21 facing the back plate 26, extending in the x direction and being a fixed interval apart in the y direction. The X electrodes 22 are used as scan electrodes when addressing is performed, and this feature is common to all the embodiments of this invention. An overall view of the plurality of pairs of display electrodes 22 and 23 is described hereafter.

A dielectric layer 24 formed from a lead oxide composite is coated over the surface of a front glass substrate 21 on which the plurality of pairs of display electrodes 22 and 23 have been arranged, so that the plurality of pairs of display electrodes 22 and 23 are embedded in the dielectric layer 24. A protective layer 25 formed from magnesium oxide (MgO) is then coated over the surface of the dielectric layer 24.

A back glass substrate 27 forming the base of the back plate 26 is manufactured in a similar way to the front glass substrate 20. A plurality of address electrodes 28 are arranged at fixed intervals in the x direction on the surface of the back glass substrate 27 facing the front plate 21, extending in the y direction, thereby forming a grid pattern with the plurality of pairs of display electrodes 22 and 23 on the front glass substrate 20. A dielectric film 29 formed from the same substance as the dielectric layer 24 is formed on the surface of the back glass substrate 27, so as to surround the address electrodes 28. Then a plurality of barrier ribs 30 of uniform width and height are formed along the y direction on the surface of the dielectric film 29, in the gaps between neighboring address electrodes 28. Red, blue and green phosphors 31, 32, and 33 are applied in turn to the sides of the barrier ribs 30 and the surface of the dielectric film 29.

The front plate 20 and the back plate 26 are fixed together using sealing glass. Then, a discharge gas including an inert gas is enclosed in the spaces formed between the plurality of barrier ribs 30. Each of these spaces is a long narrow display space 38, extending in the y direction. Areas within each discharge space 38 at which a pair of display electrodes 22 and 23 intersect with an address electrode 28 are cells (explained later in the description) for screen display. Cells are arranged in rows and columns in the x and y directions respectively, forming a matrix. As a result, the PDP can form a matrix display by switching individual cells on and off at the appropriate times.

Figure 2:
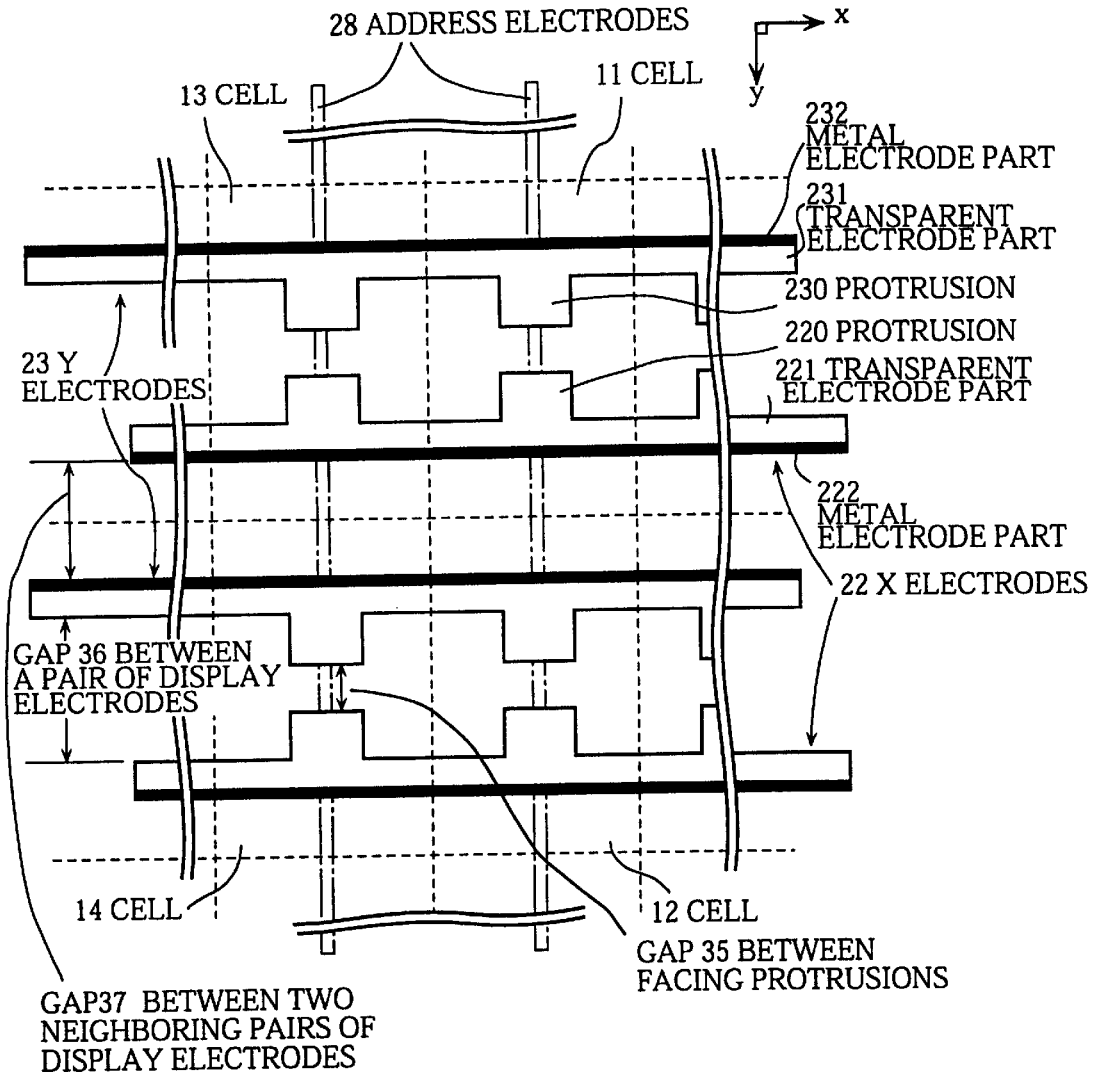
FIG. 2 is an aerial view of a pattern formed by a plurality of pairs of display electrodes in the first embodiment.
Figure 3:
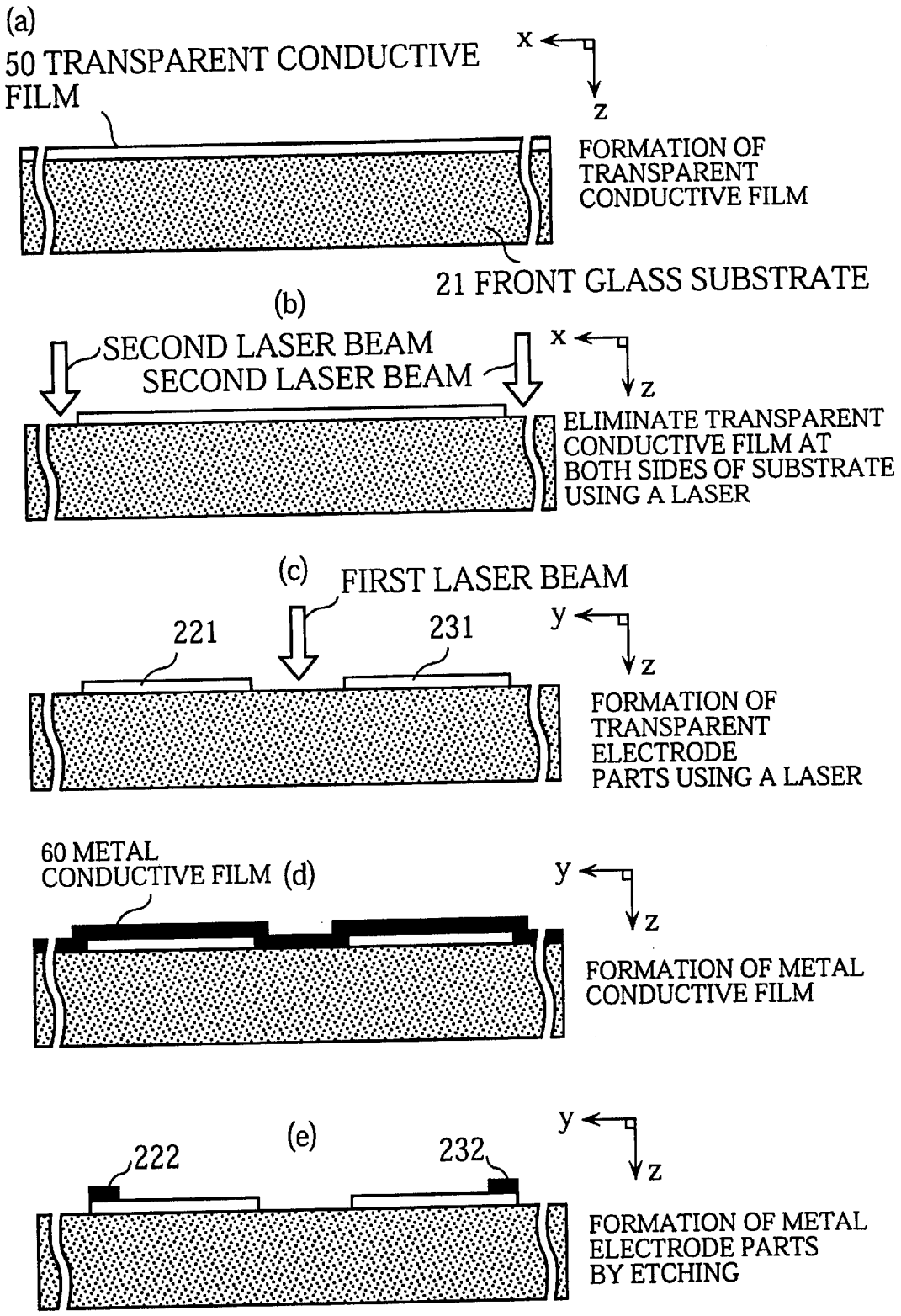
FIG. 3 is a partial cross-section of a front glass substrate 21, showing a manufacturing process for a pair of display electrodes in the first embodiment.
Figure 4:
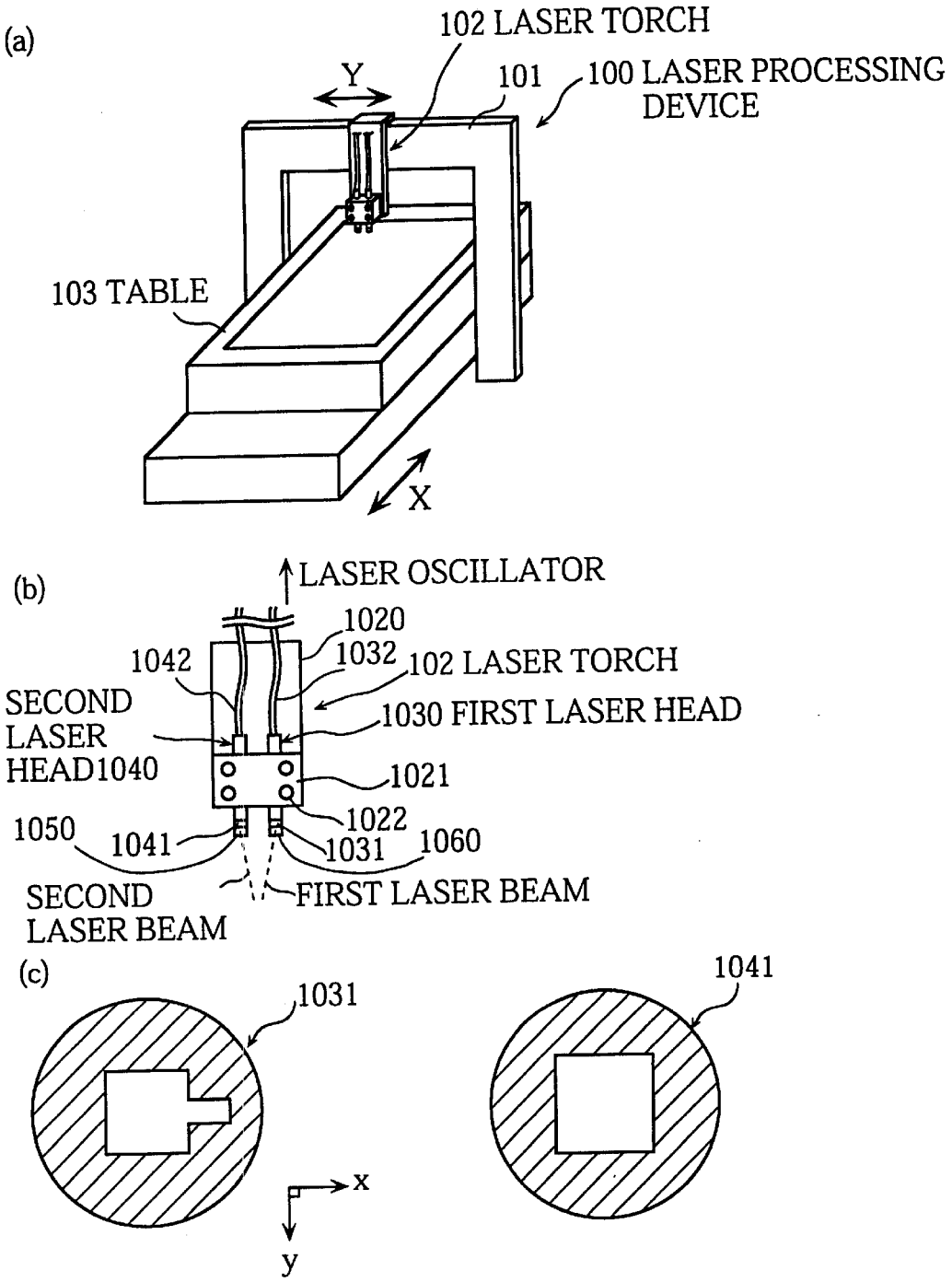
FIG. 4 shows external views of various parts of a gantry-type laser processing device 100.
Figure 5:
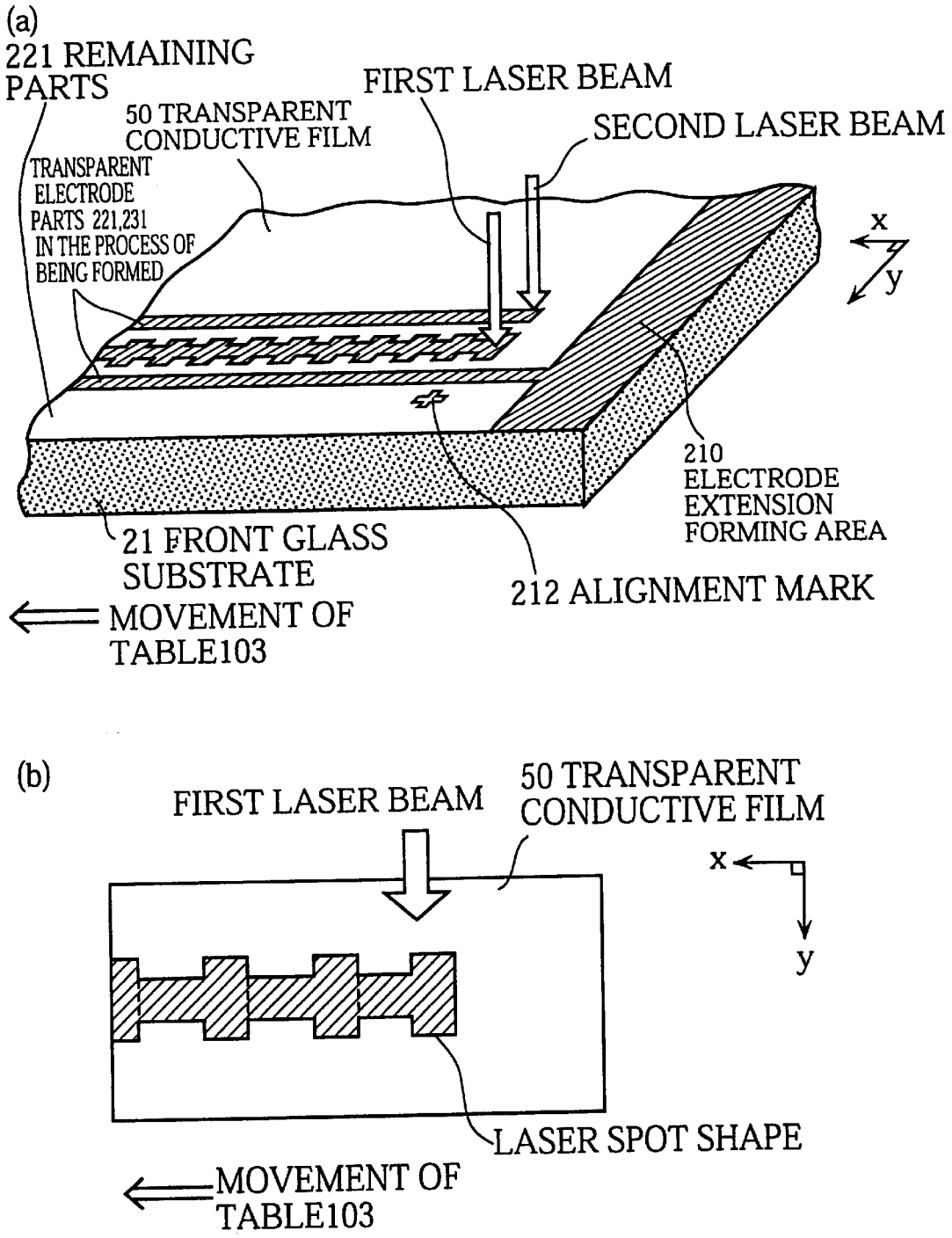
FIG. 5 shows a laser ablation process relating to the manufacture of transparent electrode parts 221 and 231 in the first embodiment.

FIG. 2 is an aerial view of the display electrode pattern of the PDP, looking down in the z direction. In order to simplify the drawing, the barrier ribs 30 are not shown. In the drawing, areas divided by broken lines correspond to cells 11, 12, 13, and 14.

As shown in FIG. 2, each of the plurality of pairs of display electrodes 22 and 23 in the PDP is formed from transparent electrode parts 221 and 231, and metal electrode parts 222 and 232. The metal electrode parts 222 and 232 are arranged, so as to be electrically connected, on the outermost parts of each of transparent electrode parts 221 and 231. The transparent electrode parts 221 and 231 have protrusions 220 and 230 respectively, protrusions 220 and 230 formed facing each other at each cell pitch (the pitch between neighboring address electrodes 28) in the gaps 36 between pairs of display electrodes 22 and 23.

The size of each part of the display electrodes 22 and 23 is as follows. A gap 35 between facing protrusions 220 and 230 is 80 μm, a maximum gap 36 between a pair of address electrodes 22 and 23 is 520 μm, and protrusions 220 and 230 are rectangular, being 150 μm in the x direction and 220 μm in the y direction. Furthermore, the width of the transparent electrode parts 221 and 231, excluding the protrusions 220 and 230, is 150 μm, and a gap 37 between neighboring pairs of display electrodes 22 and 23 is 260 μm. Here, a characteristic of the first embodiment is that the transparent electrode parts 221 and 231 described above are manufactured using the laser ablation process described later in this description.

Furthermore, the width of each of the metal electrode parts 222 and 232 is 50 μm, and the cell pitch is 360 μm.

Note that in FIG. 2, the protrusions 220 and 230 have been made proportionally larger, and the maximum gap 36 between the pairs of display electrodes 22 and 23 proportionally narrower, than is actually the case, in order to make the characteristic shape of the display electrodes 22 and 23 having the protrusions 220 and 230 clearer.

The reason for setting the transparent electrode parts 221 and 231 in this kind of pattern is to restrict the surface discharge starting voltage and therefore obtain surface discharge of a sufficient scale.

In other words, the PDP having the above structure generates two types of discharge by applying an appropriate power supply to the electrodes 22, 23, and 28 when the PDP is driven.

One type of discharge is an address discharge for controlling the switching of cells 11, 12 and so on between on and off. This discharge occurs when power is supplied to an X electrode 22 (a scan electrode) and an address electrodes 28.

The other type of discharge is sustain discharge (surface discharge) that directly contributes to the screen display performed by the PDP. This discharge occurs when a pulse voltage is applied to a pair of display electrodes 22 and 23.

Surface discharge starts when a pulse voltage is supplied to a plurality of pairs of display electrodes 22 and 23. Here, surface discharge starts in the gaps 35 between the protrusions 220 and 230, but since the gaps 35 between the protrusions 220 and 230 are each about 80 μm wide and thus narrower than the maximum gap 36 between each pair of display electrodes 22 and 23 (about 520 μm), the discharge starting voltage can be restricted to a low level.

Therefore, when the surface discharge starts, the scale of discharge gradually increases, thereby improving luminance, and restricting the level of the discharge voltage, so that the PDP has sufficient luminous efficiency.

To be more precise, if a 185V voltage is applied to the pairs of display electrodes 22 and 23 when surface discharge is generated, variations of about ±5V in the level of the actual voltage applied to the pairs of display electrodes 22 and 23 are evident in a conventional PDP. In contrast, the transparent electrode parts 221 and 231 in a PDP manufactured according to the first embodiment can be manufactured more precisely than in a conventional PDP by using laser ablation. As a result, voltage variation can be limited to ±2V. Thus, the PDP of the present invention can be given superior display characteristics, in which flicker has been reduced to less than that in a conventional PDP.

The main characteristic of the invention is a PDP manufacturing method. The following is a description of a PDP manufacturing method in the first embodiment of the invention.

PDP Manufacturing Method i. Manufacture of the Front Plate 20

Display electrodes 22 and 23 are formed on a surface of a front glass substrate 21, the front glass substrate 21 being a soda lime glass plate with a thickness of about 2.66 mm. Here, a characteristic of the invention is that the plurality of pairs of display electrodes 22 and 23 are formed using laser ablation. The procedure for forming the pairs of display electrodes 22 and 23 is explained with reference to the partial cross-sections of the front glass substrate 21 shown in FIGS. 3A to 3E, the block diagrams of the laser processing device 100 shown in FIGS. 4A to 4C, the laser ablation process shown in FIGS. 5A and 5B, the completed view of the transparent electrode parts 221 and 231 shown in FIGS. 6A and 6B, drawings showing the laser work operation performed during the laser ablation process, and the like.

The pairs of display electrodes 22 and 23 in the first embodiment are formed from the transparent electrode parts 221 and 231, and the metal electrode parts 222 and 232 mentioned previously. First, the transparent electrode parts 221 and 231 are formed by coating the entire surface of the front glass substrate 21 with a transparent conductive film of $SnO_2$—$Sb_2O_3$ (a composite in which hydrated tin oxide ($SnO_2$) and antimony oxide ($Sb_2O_3$) are mixed so that the atomic ratio of tin to antimony is 98:2) using chemical vapor deposition (CVD), forming a transparent conductive film 50 having a thickness of approximately 0.2 μm. CVD is performed by transforming the materials required to create the transparent conductive film 50 into a gas, and forming the transparent conductive film 50 by circulating the gas over the surface of the front glass substrate 21, the front glass substrate 21 having been heated to a high temperature of about 550° C. FIG. 3A shows a situation in which the transparent conductive film 50 has been formed.

Figure 6:
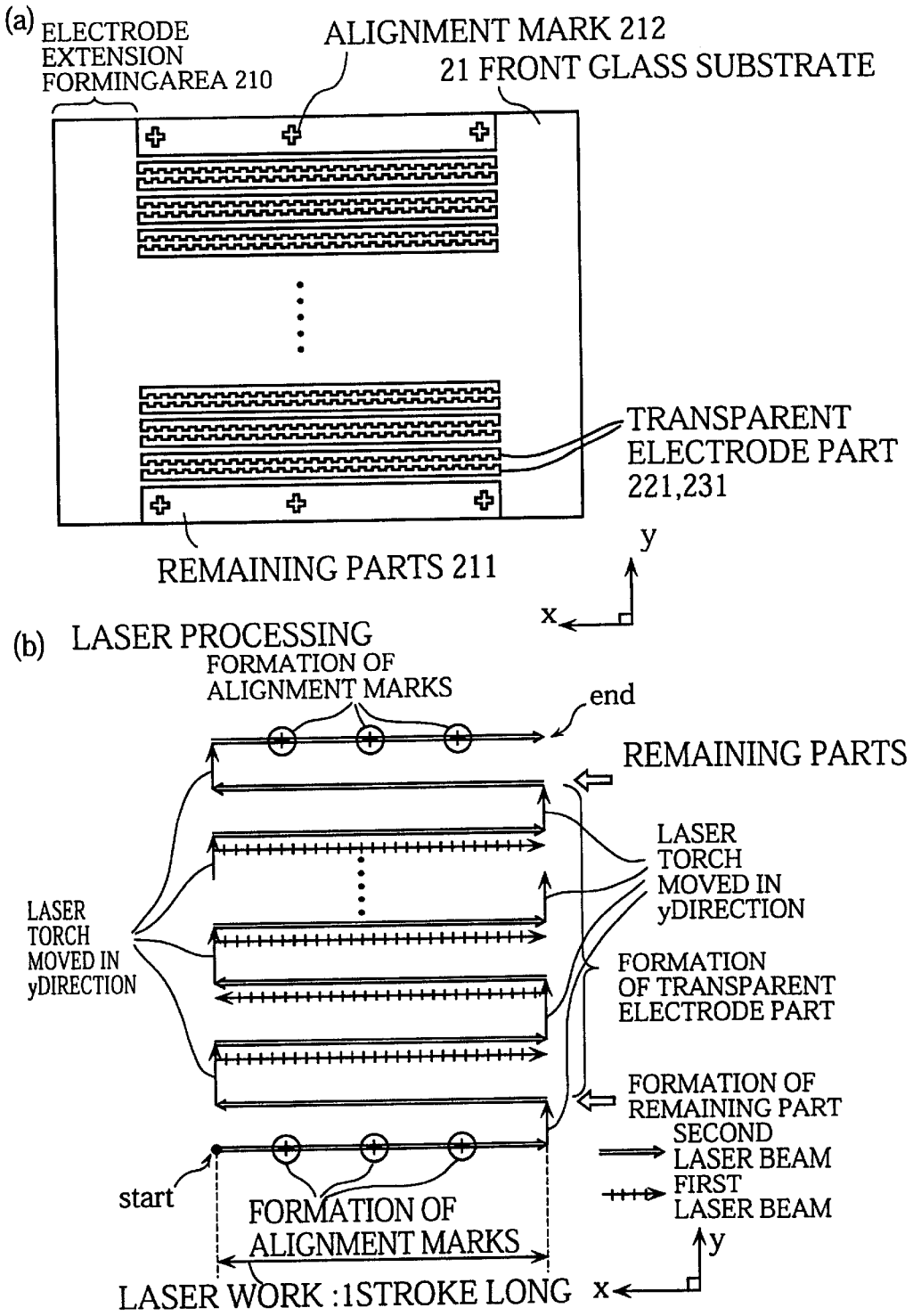
FIG. 6 shows settings for laser work relating to a laser ablation process performed by the laser processing device 100 in the first embodiment.
Figure 7:
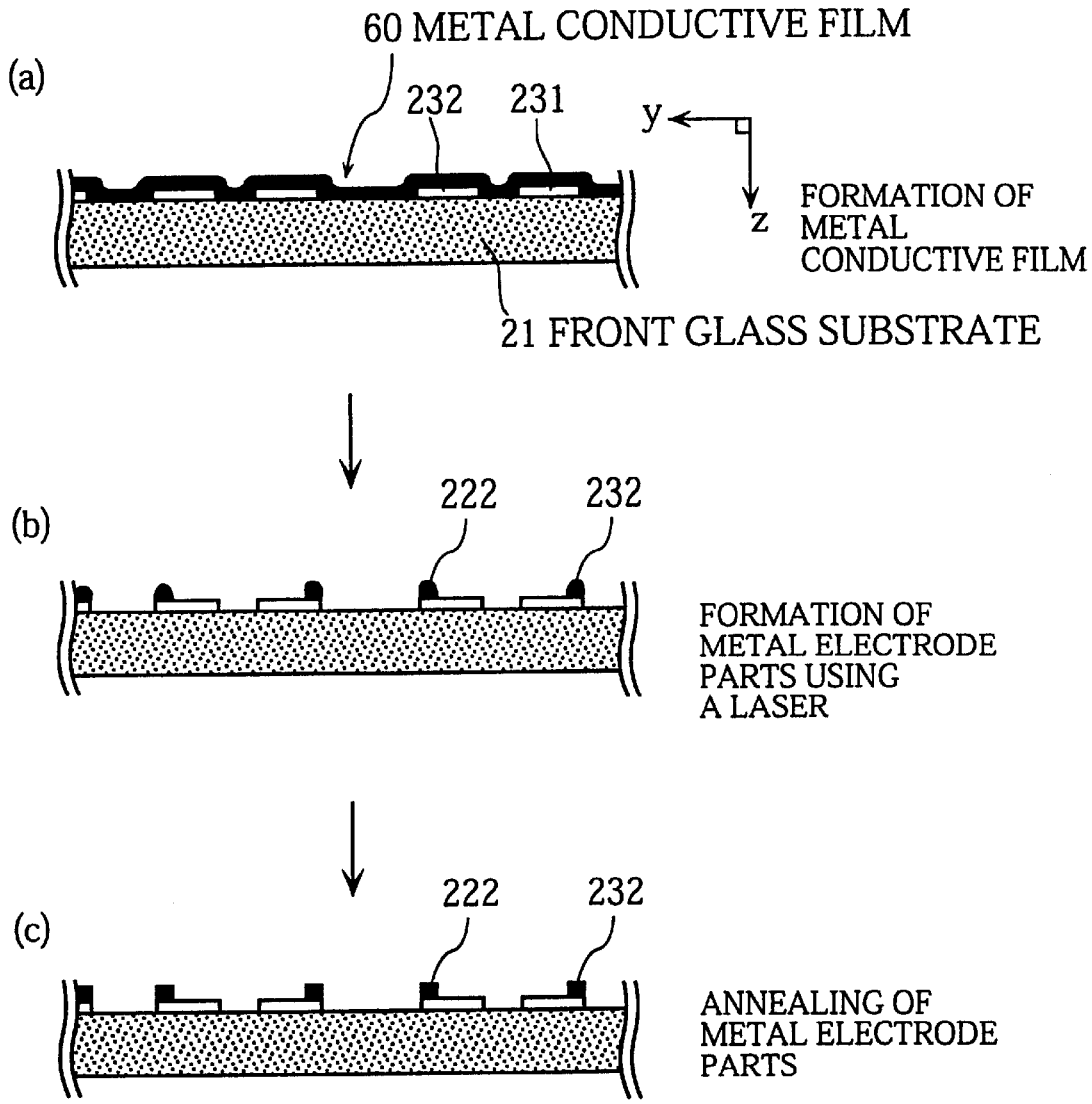
FIG. 7 is a partial cross-section of the front glass substrate 21 showing a manufacturing process for a plurality of pairs of display electrodes in a second embodiment.
Figure 8:
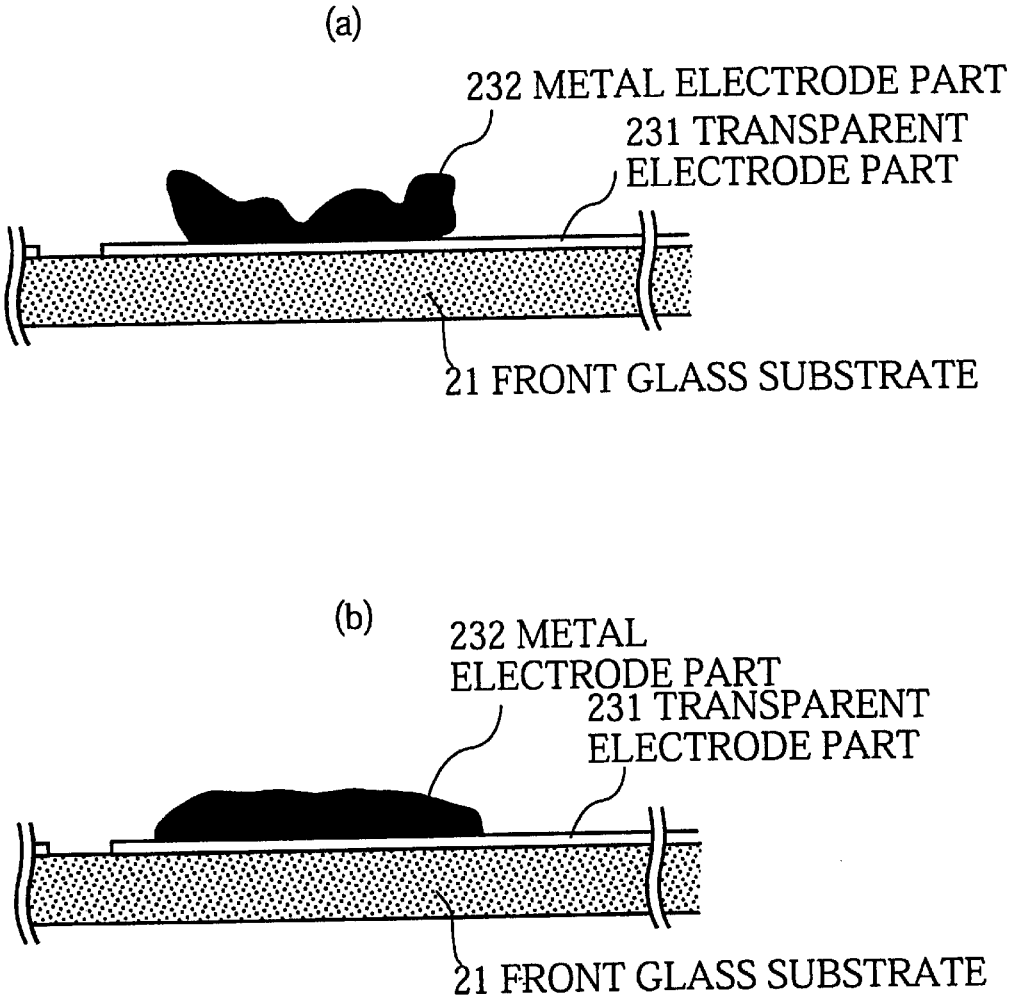
FIG. 8 shows the laser ablation process performed on the metal electrode parts 232 in the second embodiment.

Next, electrode extension forming areas 210 corresponding to a strip at each side of the front glass substrate in the x direction are secured in the transparent conductive film 50 (see FIGS. 3B and 6). Although not shown in the drawing, the electrode extension is an electrode part that extends in a straight line from the metal electrode parts 222 and 232 in order to connect the display electrodes 22 and 23 to a drive circuit (not shown in the drawing). Next, the transparent electrode film 50 is patterned to form the transparent electrodes 221 and 231 (see FIG. 3C). An illustration of the electrode extension forming areas 210 can be found in FIG. 6.

This procedure is implemented using a laser processing device 100, a diagonal view of which is shown in FIG. 4A. The laser processing device 100 is of what is known as a gantry type, and is a widely known laser processing device having a single-axle table 103 (capable of moving freely back and forth in the x direction), and a single-axle laser torch 102 (capable of moving freely back and forth in the y direction). The laser torch 102 is connected to a laser torch guide 101, which is arranged so as to straddle the table 103 in the y direction, and moves back and forth in the y direction under the guidance of the laser torch guide 101. The laser torch 102 and the table 103 are precision-driven by a stepping motor (not shown). By moving the laser torch 102 and the table 103 respectively in the x and y directions in relation to a workpiece placed on the table 103, two-dimensional laser ablation of micro order precision can be achieved.

The laser torch 102 is constructed as shown in FIG. 4B, so that a first laser head 1030 and a second laser head 1040 are fixed to a main body 1020 by fixing jigs 1021 and fastening bolts 1022. The first and second laser heads 1030 and 1040 emit a YAG (yttrium-aluminum-garnet) laser beam with a wavelength of 1.06 μm, and are connected respectively to ends of silica fiber-optic cables 1032 and 1042, the silica fiber-optic cables 1032 and 1042 extending from a laser oscillator (not shown). The first and second laser heads 1030 and 1040 are housed inside an optical unit that concentrates laser beams. Apertures 1031 and 1041 and objective lens units 1050 and 1060 are fitted to the respective ends of the first and second laser heads 1030 and 1040. Laser ablation of a uniform pattern can be performed by having the first and second laser heads 1030 and 1040 emit pulse lasers to form a plurality of connected overlapping laser spots.

Here, the aperture 1031 is formed so that it corresponds in size with the sum of the gap 35 between facing protrusions 220 and 230 and the maximum gap 36 between a pair of display electrodes 23 and 23, and the aperture 1041 is formed so that it corresponds to the size of the gap 37 between two pairs of neighboring display electrodes 22 and 23. The aperture 1031 forms a laser spot pattern on the surface of the front glass substrate 21 that has been fixed onto the table 103, using a combination of objective lens units 1050 and 1060. Here, the laser spot pattern is formed by combining rectangles of 520 $\mu$m in the y direction and 210 $\mu$m in the x direction with rectangles of 80 $\mu$m in the y direction and 150 $\mu$m in the x direction. The aperture 1041 has a slit for forming laser spots on the surface of the front glass substrate 21 that has been fixed onto the table 103, using a combination of the objective lens units 1050 and 1060. Here, the laser spots are each rectangles of 260 $\mu$m in the y direction and 360 $\mu$m in the x direction. A protrusion 1031*a* of aperture 1031 is provided to form the protrusions 220 and 230 of the transparent electrode parts 221 and 231. If first and second laser beams are output from first and second laser heads 1030 and 1040, the corresponding laser spot patterns are applied to the surface of the front glass substrate 21 on the table 103, via the apertures 1031 and 1041 and the objective lens units 1050 and 1060. Note that the size of laser spots formed on the surface of the front glass substrate 21 can be appropriately adjusted by altering the position of the first and second laser heads 1030 and 1040 in relation to the laser torch 102. The front glass substrate 21 is fixed onto the table 103 of the gantry-type laser processing device 100 constructed as above, paying attention to the orientation of the front glass substrate 21. In other words, the front glass substrate 21 is fixed horizontally onto the table 103 using a method well known in the art such as a vacuum chuck method, so that the x and y directions of the front glass substrate 21 correspond to the x and y directions of the laser processing device 100.

Next, laser beam output settings are performed. Both the first and second laser heads 1030 and 1040 have laser beams with a pulse laser output of 100 nsec/pulse, and a strength set at 1.5 mJ/pulse.

Following setting of the laser beam output, laser ablation settings are set from a fixed setting input menu for the laser processing device 100, in accordance with the pattern shown in FIG. 6A. Here, the basic laser ablation processing sequence involves performing laser ablation on the transparent conductive film 50 covering the entire surface of the front glass substrate 21, and forming transparent electrode parts 221 and 231, remaining parts of the transparent conductive film 50, and cross-shaped alignment marks. Once the laser ablation setting has been performed, and a work starting instruction input, laser ablation starts automatically.

Laser ablation may, for example, start by ensuring that the electrode extension forming areas 210 are formed at the left and right edges of the front glass substrate (in the x direction). This is performed by using the second laser beam from the second laser unit 1040 in isolation.

In other words, the positional relationship between the table 103 and the laser torch 102 is adjusted, so that one corner of the front glass substrate 21 (in FIG. 6A, the bottom left corner of the front glass substrate 21) is positioned directly beneath the second laser head 1040. Then laser ablation is performed on parts of the transparent conductive film 50 covering the front glass substrate 21 by outputting the second laser beam while moving the laser torch 102 in the y direction, with the table 103 still in a fixed position. This causes a groove with a width of 360 $\mu$m to be formed on the surface of the front glass substrate 21 in the y direction by vaporizing the transparent conductive film 50.

Once one laser ablation stroke is completed (one stroke is one pass across the front glass substrate 21 in the y direction), the table 103 is moved slightly just 360 $\mu$m, that is the x width of the laser spot of the second laser beam, in the x direction. Then laser ablation is performed as before by moving the laser torch 102 in the y direction from this position. Laser ablation is performed using this forward and backward operation for two x 56 strokes (for the two side areas of the front glass substrate 21 in the x direction), forming an electrode extension forming area 210 with a width of about 20 mm at each end of the front glass substrate 21 (in the x direction). This completes the laser ablation process shown in FIG. 3B.

Next, the remaining parts 211 of the transparent conductive film 50, alignment marks 212 and the like are formed using laser ablation. FIG. 6B is a drawing showing a visualization of the laser ablation process performed at this time. In the drawing, the positional relationship of the table 103 and the laser torch 102 is adjusted, so that one corner (in FIG. 6B the bottom left corner) of the front glass substrate 21 is positioned directly beneath the second laser head 1040. Then, crosses are formed at fixed positions on the transparent conductive film 50 by laser ablation, while moving the table 103 slightly in the x and y directions. This forms reverse alignment marks 212. Alignment marks 212 are formed, for example, by combining laser spots produced by the aperture 1041 to form a cross shape 980 $\mu$m in length in the y direction (i.e. four laser spot diameters in the y direction), and 1080 $\mu$m in length in the x direction (i.e. three laser spot diameters in the x direction). Alignment marks 212 are formed to be used for positional alignment of the transparent electrode parts 221 and 231 with the metal electrode parts 222 and 232 and for positional alignment when the front glass substrate 21 and the back glass substrate 27 are fixed together. The fixed positions of the alignment marks 212 are, for example, as shown in FIG. 6A, with three alignment marks 212 being formed 5 mm from the bottom of the front glass substrate 21 in the y direction, at intervals on a straight line extending lengthwise along the front glass substrate 21.

Once these alignment marks 212 have been formed, the table 103 is moved so that one edge of the front glass substrate 21 in the x direction (in FIG. 6B the right edge) is directly beneath the second laser head 1040. Then, the laser torch 102 is moved 5 mm in the y direction, and the front glass substrate 21 moved back in the x direction while the second laser beam is applied to the transparent conductive film 50. This laser ablation stroke (one pass of the laser beam across the front glass substrate 21 in the x direction: see FIG. 6B), forms a strip with a width of about 260 $\mu$m by vaporizing the transparent conductive film 50, with a remaining part 211 of the transparent conductive film 50 that is 10 mm wide being left at each side of the front glass substrate 21 in the x direction.

Once a remaining part 211 has been formed, the front glass substrate 21 is moved so that an edge of the front glass substrate 21 in the x direction (in FIG. 6B the left edge) is beneath the laser torch 102. Then, the laser torch 102 is moved 1080 pm in the y direction, relative to the table 103, and the first and second laser heads 1030 and 1040 are placed in an operation-ready state. (Here, the maximum gap between a pair of display electrodes 22 and 23 (520 μm)+a gap between two pairs of neighboring electrodes 22 and 23 (260 μm)+the width of a pair of display electrodes 22 and 23 excluding the protrusions 220 and 230 (150 μm×2)=1080 μm (see FIG. 2 for more details)). Following this, the table 103 is moved in the x direction while the first and second laser beams are applied in parallel to the transparent conductive film 50 in the y direction, thereby forming a gap 36 between a pair of display electrodes 22 and 23, and a gap 37 between neighboring pairs of display electrodes 22 and 23, in parallel on the front glass substrate 21. The transparent electrode parts 221 and 231 for one pair of display electrodes 22 and 23 are formed by this laser ablation process.

Here, FIG. 5A is a diagonal view of part of the front glass substrate 21 showing a situation in which a pair of display electrodes 22 and 23 are being formed by laser ablation. In this laser ablation, a laser beam is emitted as an intermittent pulse laser, as is the case for laser ablation performed by the first laser beam shown in FIG. 5B. The transparent electrode parts 221 and 231 are formed by connecting laser spots emitted by this pulse laser.

Note that electrode gaps 35 to 37 may be more accurately formed by performing laser scanning so that neighboring laser spot overlap slightly in the x direction. However, in this case, an arrangement that takes account of the overlapping laser spot portions by, for example, setting the shapes of the apertures 1031 and 1041 lengthwise in the x direction, is required.

Furthermore, an edge of the front glass substrate in the x direction need not be positioned directly beneath the first and second laser heads 1030 and 1040 when moving the laser torch 102 in the y direction. Instead, the laser torch 102 may be moved so that it is positioned directly over an end of the transparent electrode parts 221 and 231 in the x direction.

The number of laser torches used need not be limited to one, and a plurality of laser torches may be used, so that each laser head is attached to a different laser torch.

In this laser ablation process used to form the transparent electrode parts 221 and 231, processes for forming the transparent electrode parts 221 and 231 for a pair of display electrodes 22 and 23 using laser ablation, and for moving the laser torch 102 slightly about 1080 pm in the y direction are repeated in accordance with the laser ablation processing order shown in FIG. 6B. A plurality of transparent electrode parts 221 and 231 for pairs of display electrodes 22 and 23 are formed on the front glass substrate 21 (in the case of a 42-inch XGA (extended graphics array) panel a total of 768 pairs are formed) by performing a laser ablation processing sequence in which laser ablation in the x direction and movement of the laser torch 102 in the y direction are combined in a zigzag processing sequence.

Once all of the transparent electrodes 221 and 231 have been formed (FIG. 3C), driving of the first laser head 1030 is temporarily suspended. Then, the remaining part 211 at the top edge of the transparent conductive film 50 is formed as was previously explained by driving only the second laser head 1040. Once the remaining part 211 has been formed, a plurality of alignment marks 212 are formed using the previously described operation. With this, the laser ablation process for one front glass substrate 21 is completed.

A wet photolithography method conventionally performed in order to manufacture the plurality of pairs of display electrodes 22 and 23 requires approximately eleven separate steps. In contrast, the laser ablation process disclosed in the first embodiment can be completed using just three steps: a laser process step, and washing and drying process steps for which laser ablation is not required. Furthermore, the laser ablation process can be performed in just 10 minutes or so. This improves the yield of the PDP manufacturing process, and is also an effective cost-cutting measure.

The transparent electrode parts 221 and 231 can be manufactured with greater precision when using this laser ablation process than when another manufacturing method is used. If the transparent electrode parts 221 and 231 are strips extending in the x direction with a width of about 50 μm, errors in size of about ±5.0 μm will be generated when a photolithography method is used, but errors can be restricted to ±3.0 μm when the method disclosed in the first embodiment is used.

After the above laser ablation process has been performed, the front glass substrate 21 is removed from the table 103, and a metal conductive film 60 having a thickness of 0.1 μm is formed using a sputtering method by coating the surface of the front glass substrate 21, on which the transparent electrode parts 221 and 231 have been formed, with a laminated Cr—Cu—Cr film (FIG. 3D).

Next, a wet photolithography process is used on the metal conductive film 60, thereby forming metal electrode parts 222 and 232 (FIG. 3E) and electrode extensions (not shown). The wet photolithography process is conventionally performed using the following steps (a) to (k): (a) washing the metal conductive film 60→(b) applying a photoresist to the metal conductive film 60→(c) drying→(d) applying a mask in the shape of the metal electrode parts 222 and 232 and exposing the photoresist→(e) developing→(f) rinsing→(g) washing and drying→(h) hardening the photoresist remaining on top of the metal conductive film 60→(i) etching→(j) peeling off the photoresist→(k) washing and drying.

Note that the mask is applied in step (d), so as to be aligned on the metal conductive film 60 using the alignment marks 212. This ensures that accurate developing can be performed.

Furthermore, the metal electrode parts 222 and 232 are here formed along the outer edges of each of the transparent electrode parts 221 and 231 in each pair of display electrodes 22 and 23, in strips with a width of about 50 μm.

Next, a lead glass paste is applied to the entire surface of the front glass substrate 21 over the tops of plurality of the display electrodes 22 and 23 at a thickness of about 20 to 30 μm, and fired to form the dielectric layer 24.

Following this, a protective layer 25 of MgO with a thickness of about 1 μm is formed on the surface of the dielectric layer 24 using vapor deposition or CVD.

This completes manufacture of the front plate 20.

ii. Manufacture of the Back Plate 26

A conductive material with silver as a main component is applied, using screen printing, at fixed intervals in a stripe pattern to the surface of a back glass substrate 27, the latter being a soda lime glass plate with a thickness of 2 mm. This forms a plurality of address electrodes 28, having a thickness of 5 μm. Here, the interval between neighboring address electrodes 28 is set at 360 μm.

Next, a lead glass paste is applied at a thickness of between 20 μm to 30 μm to the entire surface of the back glass substrate 26 on which the address electrodes 28 have been formed, and then fired, thereby forming the dielectric film 29.

Then, barrier ribs 30 with a height of about 100 $\mu$m are formed in the intervals between neighboring address electrodes 28 on the surface of the dielectric film 29 using the same kind of lead glass substance as was used for the dielectric film 29. The barrier ribs 30 can be formed, for example, by repeatedly applying a paste including the lead glass substance by using screen painting, and then firing the result.

Once the barrier ribs 30 have been formed, phosphor inks including each of red, green and blue phosphors is applied to the sides of the barrier ribs 30 and parts of the surface of the dielectric film 29 exposed between the barrier ribs 30, and then dried and fired to form phosphor layers 31, 32, and 33.

An example of the phosphors typically used in a PDP is as follows.

Red phosphor: $(Y_xGd_{l-x})\ BO_3$: $Eu^{3+}$

Green phosphor: $Zn_2SiO_4$: Mn

Blue phosphor: $BaMgAl_{10}O_{17}$: $Eu^3$+ (or $BaMgAl_{14}O_{23}$: $Eu^{3+}$)

This completes the manufacture of the back plate 26.

Here, the front and back glass substrates 21 and 27 are described as being made of soda lime glass, but this is just one example of a substance that may be used, and other substances, such as glass with a high distortion point, may be used. Furthermore, the dielectric layer 24 and the protective layer 25 need not be made of the above-mentioned substances, and may be replaced by appropriate substitutes. Similarly, substances for the plurality of display electrodes 22 and 23 may be selected so that, for example, transparent electrode parts 221 and 231 have a satisfactory transparency. Selection of each substance may be performed in a similar way in each embodiment, in so far as it is possible to do so.

iii. Completion of the PDP

The manufactured front plate 20 and back plate 26 are aligned using the alignment marks 212, and fixed together with sealing glass. Then, the inside of discharge spaces 38 is degassed to form a high vacuum of $8\times10^{-7}$ Torr. The PDP is completed by filling the discharge spaces 38 with a discharge gas formed from a mixture of Ne—Xe (neon and xenon: the latter being 5% of the mixture) at a certain pressure (here, 2000 Torr). The discharge gas may also be a mixture of He—Xe (helium and xenon) or of He—Ne—Xe (helium, neon, and xenon).

In a manufacturing method such as the one described in the first embodiment, a laser ablation process is performed by applying laser beams having two different laser spots in parallel when manufacturing the transparent electrode parts 221 and 231. A characteristic of this method is that the transparent electrodes 221 and 231 can be manufactured quickly. Therefore, the method disclosed in the first embodiment should enable the PDP to be manufactured extremely efficiently.

Furthermore, the method disclosed in the first embodiment uses fewer processes that employ photolithography than is the case in a conventional manufacturing method. Consequently, problems accompanying the generation of exhaust gas, waste solution and the like are reduced, and so this method is extremely effective as an anti-pollution measure.

The first embodiment discloses an example of a laser ablation process in which other parts of the transparent conductive film 50, apart from the transparent electrode parts 221 and 231, remain unvaporized (here, the remaining parts 211). Here, unnecessary laser ablation processing is omitted by leaving parts of the transparent conductive film 50 that do not need to be actively vaporized to form the plurality of display electrodes 22 and 23 and the like untouched. As a result, the laser ablation processing sequence can be simplified and made faster, and manufacturing yield improved.

Furthermore, if alignment marks are also formed on the back plate 26, and aligned with the alignment marks 212 when the process described in 'iii. Completion of the PDP' is performed, even more precise alignment is likely to be achieved.

In the PDP manufacturing method of the present invention, each embodiment is characterized by a method used to manufacture the plurality of pairs of display electrodes 22 and 23, and other parts of the manufacturing process are, in the main, shared by both the embodiments. Therefore, the PDP manufacturing method described in the following embodiment concentrates mainly on the description of the manufacturing method for the plurality of pairs of display electrodes 22 and 23, and omits explanation of processes identical to those in the first embodiment.

Second Embodiment

When the metal electrode parts 222 and 232 of the plurality of pairs of display electrodes 22 and 23 are formed using a silver material, a second embodiment discloses an example in which a laser ablation process is used for the formation and the annealing of the metal electrode parts 222 and 232.

A silver material (here a composite of silver and powdered glass) is widely used for the metal electrode parts 222 and 232, in place of a Cr—Cu—Cr material. However, when such a silver material is coated over the top of the transparent conductive film 50 (transparent electrode parts 221 and 231) certain properties possessed by the silver material cause it to be distorted into a shape having a plurality of pits and protrusions. As a result, when the dielectric layer 24 is formed over the entire surface of the front glass substrate 21, air bubbles are trapped between the metal electrode parts 222 and 232 and the dielectric layer 24, thereby causing an electrical breakdown that prevents the PDP from being driven properly.

A Consequently, when manufacturing the metal electrode parts 222 and 232 from the silver material, it is desirable to perform the following process. The metal conductive film 60 (or the metal electrode parts 222 and 232) covering the transparent conductive film 50 (or the transparent electrode parts 221 and 231) is heated, thereby melting the glass component of the metal conductive film 60 (or the metal electrode parts 222 and 232), and making the metal conductive film 60 (or the metal electrode parts 222 and 232) form a smooth shape. This is referred to as annealing.

In response to the previously mentioned problem, once the metal electrode parts 222 and 232 have been formed by the first laser beam from the first laser head 1030, the second embodiment performs annealing on the metal electrode parts 222 and 232 using the second laser beam from the second laser head 1040. The actual procedure performed is as follows.

FIGS. 7A to 7C are partial cross-sections of the front glass substrate 21, showing the manufacturing process performed on the plurality of pairs of display electrodes 22 and 23 in the second embodiment. Note that the shape of the pairs of display electrodes 22 and 23 is identical to that described in the first embodiment.

First, the transparent electrode parts 221 and 231 are formed in a uniform shape on the surface of the front glass substrate 21, using a screen printing method or similar. Here, a material that is ablated at a higher temperature than the silver material, in other words a material that will not be vaporized when laser ablation is performed on the metal electrode film 60 formed from the silver material, is used to form the transparent electrode parts 221 and 231. One actual example of such a material used for the transparent electrode parts 221 and 231 is tin oxide ($SnO_2$).

Next, the silver material is applied to the surface of the front glass substrate 21 on which the transparent electrode parts 221 and 231 have been formed, using a method such as screen printing, and then fired to form the metal conductive film 60 (thickness about 0.1 $\mu$m). FIG. 7A shows an example in which the metal conductive film 60 has been formed over the entire surface of the front glass substrate 21, but the metal conductive film 60 may be formed over a more limited area, so that the silver material may, for example, cover only the top of the transparent electrode parts 221 and 231.

Next, the laser processing device 100 is used to perform settings for laser ablation. Here, the first laser beam from the first laser head 1030 is used to form the metal electrode parts 222 and 232. By combining the aperture (not shown) fitted to the first laser head 1030 with the objective lens unit 1050, the first laser head 1030 may be set so as to form laser spots on the surface of the front glass substrate 21 fixed to the table 103, each for example, being 520 $\mu$m in the y direction (approximately equal to the gap 36 between one pair of display electrodes 22 and 23, and 360 $\mu$m in the x direction. Then, the strength of the first laser beam is adjusted to a level that will not adversely affect the transparent electrode parts 221 and 231 that are located beneath the metal conductive film 60 (in other words, a level that will not ablate the transparent electrode parts 221 and 231), but of sufficient strength that laser ablation for the metal conductive film 60 can be performed satisfactorily.

Next, the strength of the second laser beam is set. Here, since the second laser beam is used to anneal the metal electrode parts 222 and 232, the strength of the second laser beam is set at a level sufficient to melt the glass component of the metal electrode parts 222 and 232, but not high enough to be absorbed by the transparent electrode parts 221 and 231 (i.e. at a visible light wavelength near to ultraviolet light).

Furthermore, the fixed positions of the first and second laser heads 1030 and 1040 of the laser torch 102 are adjusted, setting the size of the laser spots, and the position of the laser spots relative to the metal conductive film 60 covering the front glass substrate 21.

Note that here the laser processing device 100 is described as being set so that the first and second laser heads 1030 and 1040 are driven in parallel, but the invention need not be limited to this laser ablation process. Instead, for example, the laser ablation performed by the second laser head 1040 may be started once the laser ablation performed by the first laser head 1030 has been completely finished.

Once setting of the alignment of the first and second laser heads 1030 and 1040, and of the strength of each laser beam has been completed, laser ablation process starts, so that parts of the metal conductive film 60, apart from the metal electrode parts 222 and 232 and the electrode extensions (not shown), are vaporized. As a result, metal electrode parts 222 and 232 with a width of about 50 $\mu$m, as shown in FIG. 7B, are formed.

However, at this point, the shape of the metal electrode parts 222 and 232 is distorted into a shape with a large number of pits and protrusions, as shown in the cross-section of the front glass substrate 21 in FIG. 8A. This phenomenon is caused by certain properties of the silver material, but if it is left unaltered, a large number of air bubbles will be trapped when the dielectric layer 24 is formed, as previously described, and the performance of the PDP will be reduced.

Here, as a characteristic of the second embodiment, the second laser beam from the second laser head 1040 is used to anneal the metal electrode parts 222 and 232 that have been formed by the first laser head 1030 as shown in FIG. 8A (FIG. 7C). This melts the glass components of the metal electrode parts 222 and 232, thereby making the surface of the metal electrode parts 222 and 232 smooth, as shown in FIG. 8B. If this embodiment is used, the metal electrode parts 222 and 232 can be quickly manufactured using the laser ablation process. In addition, performing the processes for forming and annealing the metal electrode parts 222 and 232 in parallel, enables high-quality PDPs to be manufactured at a high yield, even if a substance that is prone to generate pits and protrusions, such as a silver material, is used to form the metal conductive film 60.

To give more precise details, the presence of as many as 24 air bubbles of about 10 $\mu$m in diameter has been verified in the dielectric layer 24 of a conventionally manufactured XGA PDP, but in a PDP manufactured using the method disclosed in the present embodiments that figure is reduced to about one. As a result, the resistance of the PDP to electrical breakdown is increased from the conventional level of about 800V to about 2 kV.

Note that the laser strength may be such that as to have a wavelength equivalent to that of visible light, as one idea for ensuring that the first laser beam from the first laser head 1030 only ablates the metal conductive film 60.

Furthermore, as a variation of the second embodiment, the transparent electrode parts 221 and 231 may be formed by a separate laser ablation step, prior to forming the metal electrode parts 222 and 232 using laser ablation. In this case, alignment marks 212 are formed by processing the transparent electrode parts 221 and 231 as described in the first embodiment, and then the metal electrode parts 222 and 232 can be formed in the correct positions using the alignment marks 212, and annealing performed. Here, appropriate masking is required to prevent the metal conductive film 60 from covering the alignment marks 212.

Furthermore, in the second embodiment, an example in which the laser ablation of the metal electrode parts 222 and 232 is a performed in parallel with annealing of the metal electrode parts 222 and 232 is described but, alternatively, the formation and the annealing of the transparent electrode parts 221 and 231 may be performed in parallel. In other words, the first laser beam may perform patterning of the transparent electrode parts 221 and 231, while the second laser beam is used to anneal the transparent electrode parts 221 and 231 (or the transparent conductive film 50). In this case, the diameter of crystal particles in the $SnO_2$ quadruples. These crystals form the transparent electrode parts 221 and 231 (or the transparent conductive film 50), and such an increase in size improves their ability to bond with the metal electrode parts 222 and 232 (or the metal conductive film 60).

In actual fact, this annealing enables the proportion of withstand voltage defects occurring during manufacture of the transparent electrode parts 221 and 231 that can be repaired to be improved from the conventional level of about 80% to about 96%.

Here, the strength of the second laser beam should be about 30% stronger than that used for annealing the metal electrodes 222 and 232, due to the transparency of the transparent electrode parts 221 and 231.

Other Variations of the Embodiments

The following describes a number of other applications of the invention not described in the first and second embodiments.

First Variation

Figure 9:
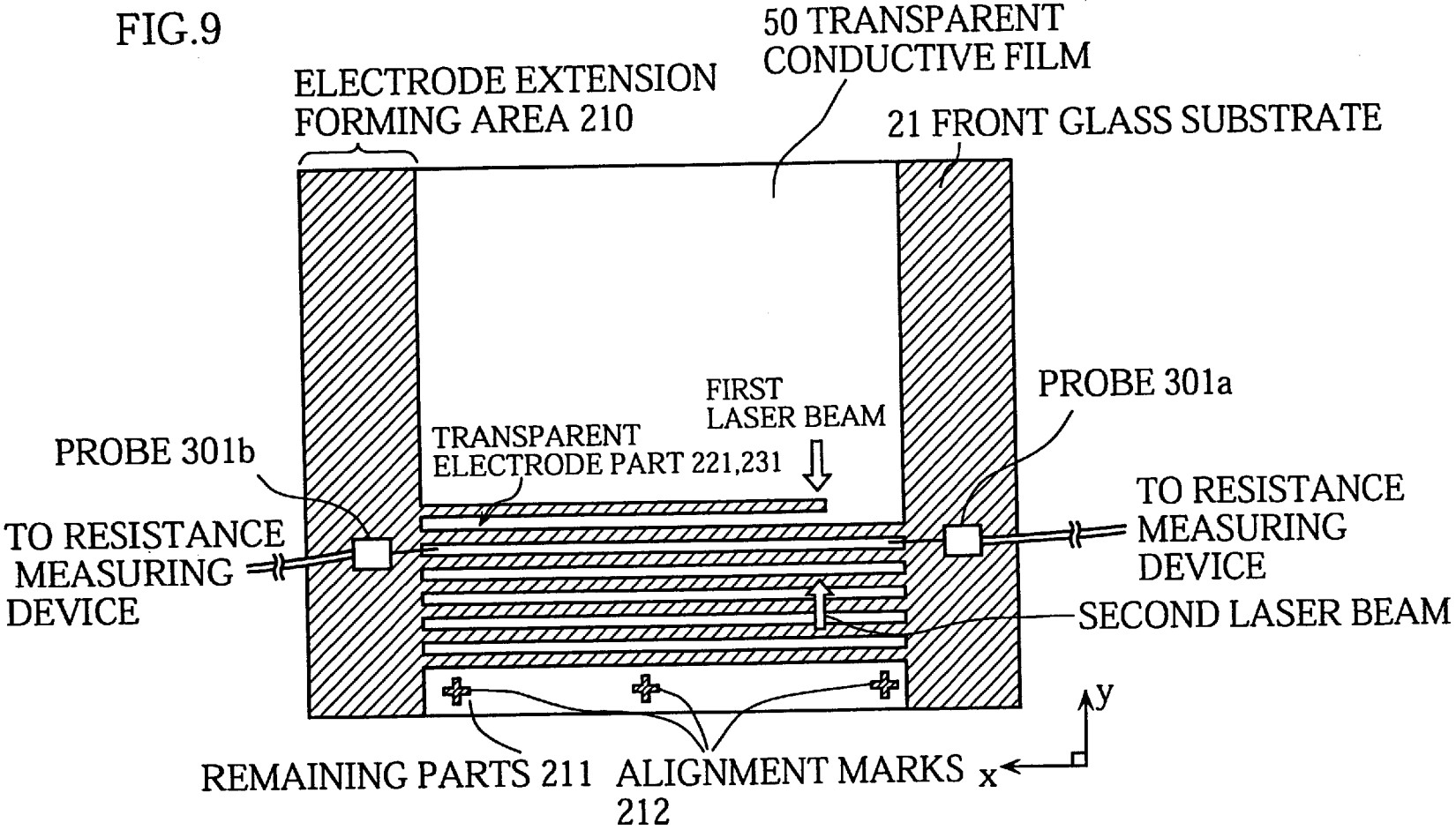
FIG. 9 is a front view of the front glass substrate 21, showing a laser ablation process in a first variation of the embodiments (manufacture of the transparent electrodes 221 and 231 and adjustment of resistance values thereof)

FIG. 9 is a frontal view of the front glass substrate 21, showing a situation in which the transparent electrodes are being manufactured according to a variation of the PDP manufacturing method described herein. As shown in the drawing, in this first variation, the transparent electrode parts 221 and 231 are formed using the laser ablation process and line resistance values of each of the transparent electrode parts 221 and 231 are measured. Then, arbitrary transparent electrode parts 221 and 231 are refined based on the corresponding line resistance values, and the line resistance values corrected.

To be more precise, the transparent conductive film 50 covering the surface of the front glass substrate 21 is processed using laser ablation to form the transparent electrode parts 221 and 231 (in FIG. 9 the shape of the transparent electrode parts 221 and 231 is depicted using straight lines to made it easier to understand). Here, the gap 36 between a pair of display electrodes 22 and 23, and the gap 37 between pairs of neighboring display electrodes 22 and 23 are formed using only the first laser beam, with the gap 37 between pairs of neighboring display electrodes 22 and 23 formed by scanning the first laser beam in the x direction for several successive strokes.

Next, probes 301*a* and 301*b* are brought into contact with the ends of each of the transparent electrode parts 221 and 231 in the x direction, and the line resistance of the transparent electrode parts 221 and 231 measured using a widely known line resistance measuring device (not shown) that has been connected to the probes 301*a* and 301*b*. The probes 301*a* and 301*b* are fixed to the sides of the laser torch guide 101, and the line resistance measuring device has already been connected to a control unit (for example an input terminal such as a personal computer) of the laser processing device 100. In addition, a reference value for comparison is stored in a memory of the input terminal (not shown), and the input terminal successively compares line resistance values of the transparent electrodes 221 and 231 obtained from the line resistance measuring device with the reference value. Then, in order to correct errors in the line resistance value of certain transparent electrodes 221 and 231 calculated as a result of the comparison, a second laser beam strength appropriate for the degree of error involved is set in the input terminal, and the second laser beam applied to the corresponding transparent electrode parts 221 and 231.

As a result, the transparent electrode parts 221 and 231 to which the laser is applied are refined, thereby correcting the line resistance value, and a PDP having uniform display characteristics when driven can be manufactured.

In other words, in this first variation, the processes for (1) forming the transparent electrode parts 221 and 231 using the first laser beam, (2) measuring line resistance values of the transparent electrode parts 221 and 231, and (3) correcting the line resistance values of the transparent electrode parts 221 and 231 using the second laser beam, based on the measured resistance values, can be performed in parallel.

To give a specific example, an average line resistance value of the transparent electrodes 221 and 231 after formation is conventionally about 1.0 kΩ, and a degree of variation σ is about 17%. The correction of line resistance values performed in this first variation, however, produces an average line resistance value of 0.5 kΩ, and the degree of variation σ is improved to about 7%.

Second Variation

Figure 10:
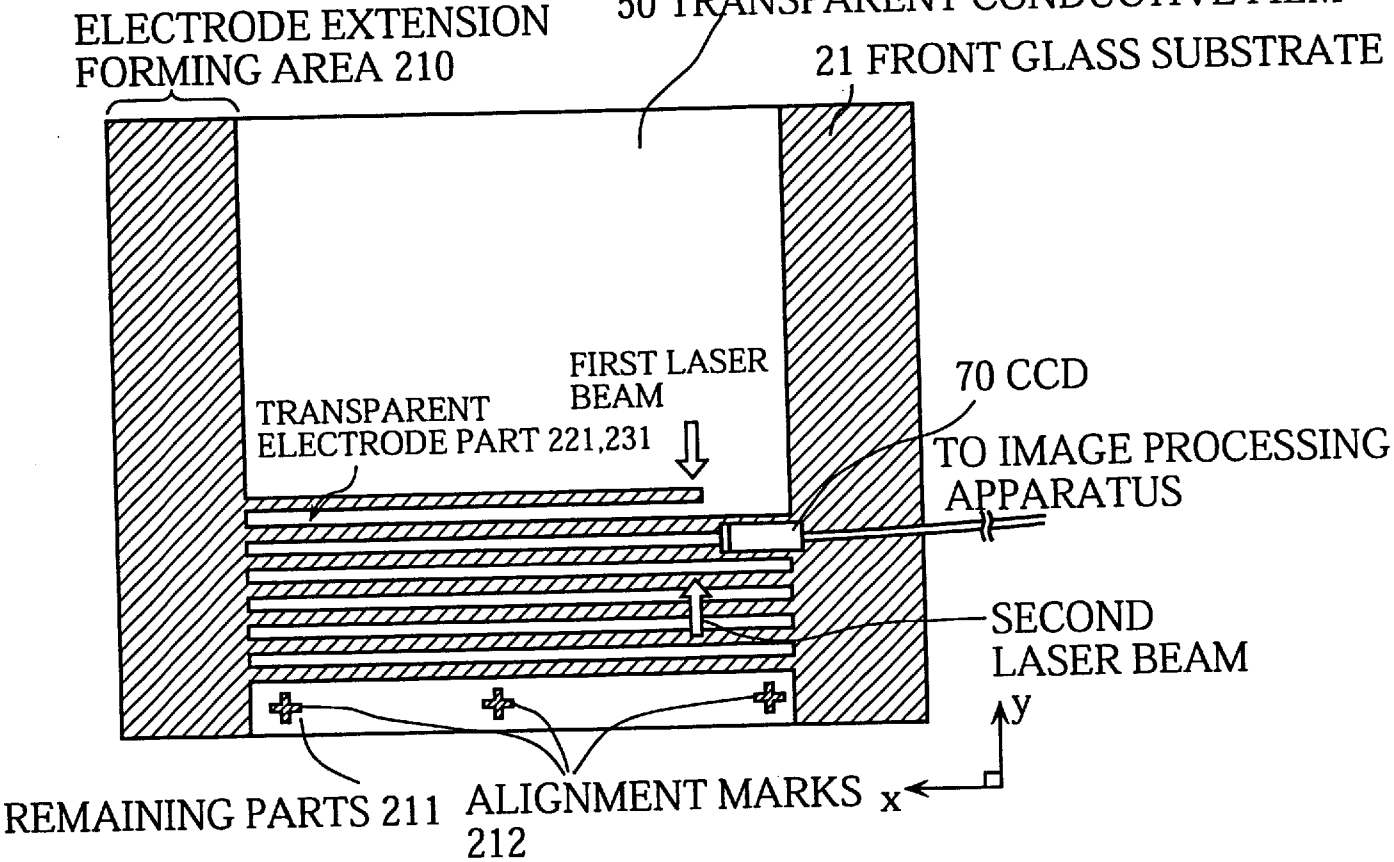
FIG. 10 is a front view of the front glass substrate 21 showing a laser ablation process in a second variation of the embodiments (manufacture of the transparent electrodes 221 and 231 and detailed repairs performed thereon)

FIG. 10 is a frontal view of the front glass substrate 21 showing a situation in which the transparent electrode parts 221 and 231 are being manufactured according to a variation of the PDP manufacturing method described herein. In the first variation, an example in which transparent electrode parts 221 and 231 are formed and then the line resistance value of the formed transparent electrode parts 221 and 231 measured is described. This second variation, however, is characterized by a process in which a detailed structure of the formed transparent electrode parts 221 and 231 is examined using a CCD (charge coupled device) camera, and problem areas repaired.

To be more precise, once transparent electrode parts 221 and 231 have been formed, they are photographed using a CCD camera 70 fixed to the side of the laser torch guide 101. Next, the pictures of the transparent electrode parts 221 and 231 obtained by the CCD camera 70 are input into an input terminal, such as a personal computer, connected to the control unit of the laser processing device 100, and a well known PM (pattern matching) process is performed. Then, parts of the shape of the transparent electrode parts 221 and 231 in which problems have been detected by the PM process (for example, undesirable small pits and protrusions) are repaired by applying the second laser beam.

If this second variation is applied, the time required to perform the PDP manufacturing process, as well as the number of process steps required, can be reduced, and variations in shape restricted, enabling a PDP having transparent electrode parts 221 and 231 of a uniform quality to be manufactured.

Third Variation

Figure 11:
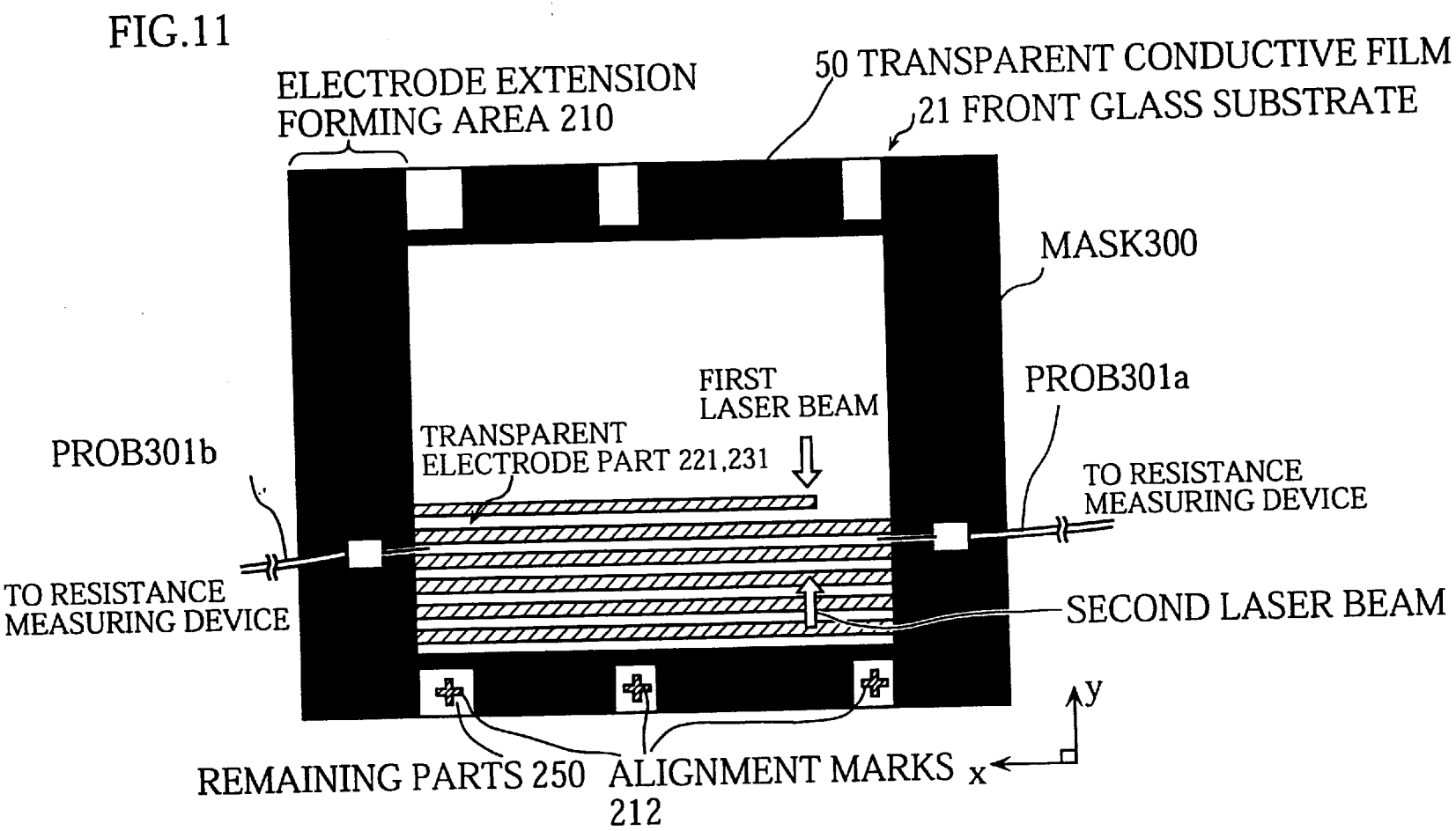
FIG. 11 is a front view of the front glass substrate 21 showing a laser ablation process in a third variation of the embodiments (manufacture of the transparent electrodes 221 and 231 and adjustment of resistance values thereof, when a mask 300 has been affixed to the front glass substrate 21)

FIG. 11 is a frontal view of the front glass substrate 21 showing a situation in which the transparent electrode parts 221 and 231 and the like are formed according to a third variation of the PDP manufacturing method, described herein. This third variation, like the first variation, measures line resistance values for transparent electrode parts 221 and 231, and refines certain transparent electrode parts 221 and 231 based on corresponding measured line resistance values, thereby correcting the line resistance value. However, the third variation is characterized by adding a process, in which a mask 300 is applied to part of the front glass substrate 21, to this processing sequence.

In other words, when the transparent conductive film 50 is formed on the front glass substrate 21 using sputtering or a similar method, the method in the third variation involves arranging the mask 300, prior to performing sputtering, so as to cover areas of the front glass substrate 21 from which the transparent conductive film 50 would have to be eliminated were it to be applied. This enables the application area of the transparent conductive film 50 to be reduced efficiently. As a result, the laser ablation process can be simplified, thus shortening the amount of time required for the process, and improving yield.

Note that remaining parts 250 form part of the transparent conductive film 50 since these remaining parts 250 are used to form the alignment marks 212, but if there is no need to form the alignment marks 212, the mask 300 can also be applied to these remaining parts 250.

A device similar to the mask 300 may also be used in the first and second embodiments, and in the first and second variations.

In addition, as a further variation, the transparent electrode parts 221 and 231 or the metal electrode parts 222 and 232 may be formed by applying the first laser beam, and then the second laser beam applied to the transparent electrode parts 221 and 231 or the metal electrode parts 222 and 232. The reflected second laser beam is captured by a well-known laser microscope, and the shape of the transparent electrode parts 221 and 321 or the metal electrode parts 222 and 232 examined.

Cross-section of Transparent Electrode Parts Formed by Laser Ablation

Figure 12:
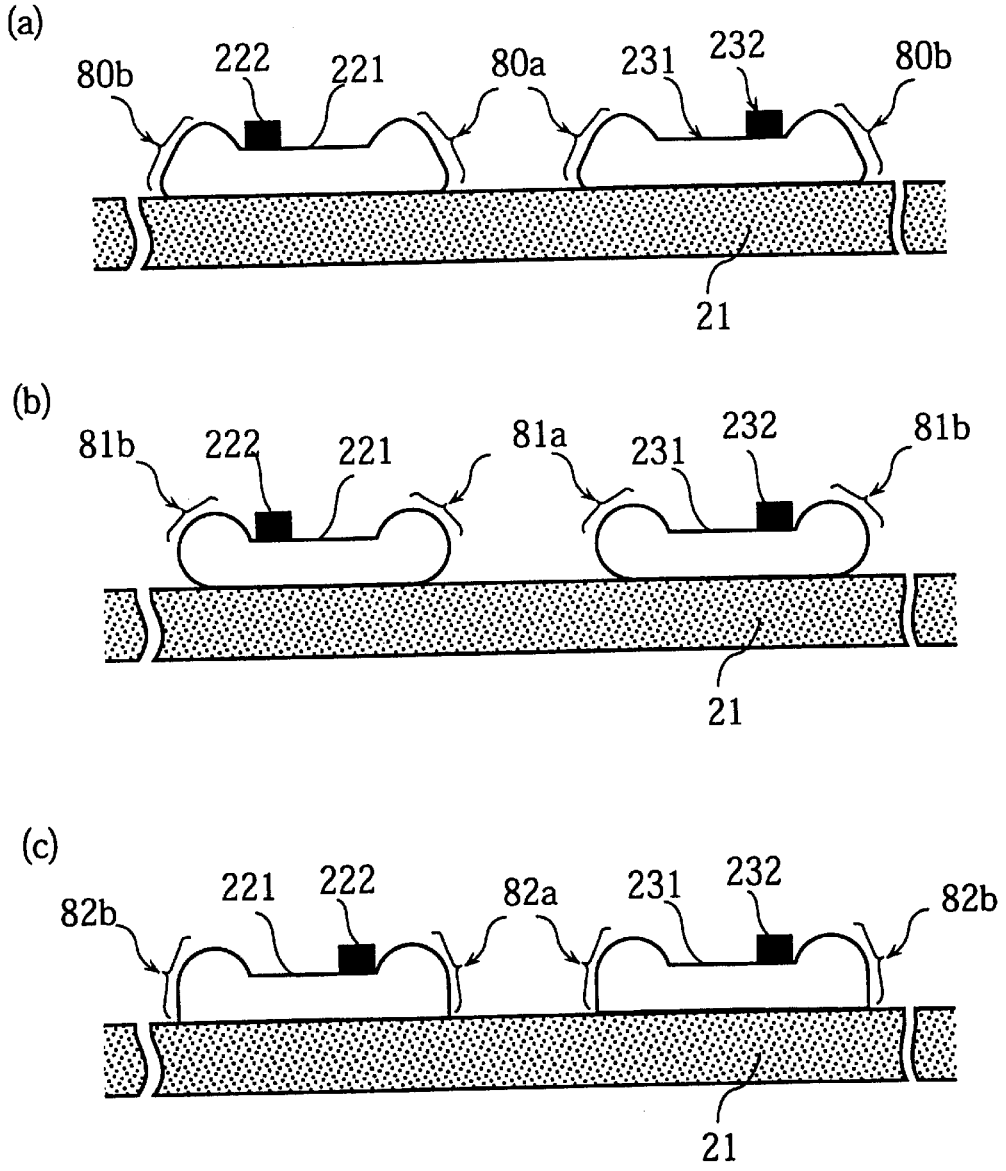
FIG. 12 is a cross-section of the front glass substrate 21 showing shapes of edges 80*a* to 82*a,* and 80*b* to 82*b,* of the transparent electrode parts 221 and 231 in the first variation of the embodiments.

FIG. 12A is a cross-section of the front glass substrate 21 along the z direction, showing, as one example, the shape of the transparent electrodes 221 and 231 manufactured based on the first variation of the PDP manufacturing method.

In other words, the transparent electrodes 221 and 231 shown in FIG. 12A are shaped so as to curve upward higher at edges 80*a* and 80*b* than at the center. The edges 80*a* and 80*b* are processed so that portions having an acute angle are smoothed into a rounded shape. Research has shown that this kind of shape can be achieved if ITO is used for the transparent conductive material.

Here, the concept denoted by the term 'rounded shape' does not only include perfect spheres, but also any shape which has an obtuse angle (i.e. an angle of more than 90°), rather than an acute angle (an angle of 90° or less).

Next, as shown in FIG. 12B, edges 81*a* and 81*b* curve upward in the z direction (in other words toward the back plate 26), and have a smooth shape with no acute angles. Research has shown that this kind of shape can be achieved if $SnO_2$ is used for the transparent conductive material.

In FIG. 12C, edges 82*a* and 82*b* protrude vertically upward in the z direction (toward the back plate 26) from the xy plane formed by the front glass substrate 21, the upper portion of each edge 82*a* and 82*b* being rounded, and having a smooth shape with no acute angles. The shape of edges 82*a* and 82*b* shown in FIG. 12C can be obtained by further processing the shape shown in either FIG. 12A or 12B. The processing for these shapes is described later in this specification.

If the transparent electrode parts 221 and 231 are formed with edges 80*a* to 82*a* and 80*b* to 82*b* shown in any one of FIGS. 12A to 12C, the following effects can be obtained.

Conventionally, since an electric field for surface discharge tends to concentrate in the angled parts of the plurality of pairs of display electrodes 22 and 23 bordering the discharge spaces 38, the electric field is concentrated at areas near to the angled parts of the pairs of display electrodes 22 and 23, making it more likely that abnormal discharge will be generated.

In contrast, if the transparent electrode parts 221 and 231 are provided with one of edges 80*a* to 82*a* and 82*a* to 82*c* or similar, the angled parts of the pairs of display electrodes 22 and 23 bordering the discharge spaces 38 no longer exist. Consequently, the phenomenon in which the electric field generated in the discharge spaces 38 is concentrated in parts nearer to the angled parts is reduced. Therefore, generation of abnormal discharge and electrical breakdowns in the dielectric layer 24 can be avoided.

Furthermore, edges 80*a* to 82*a,* and 80*b* to 82*b* protrude upward higher than the central parts of the transparent electrode parts 221 and 231 (in other words, the part of the dielectric layer 24 covering the edges 80*a* to 80*c,* and 81*a* to 81*c* is thinner), thereby enabling the voltage at both the discharge start time and the sustain discharge time of the surface discharge to be reduced.

To be precise, marked effects can be produced when the radius of the rounded parts of the edges 80*a* to 82*a,* and 80*b* to 82*b* is about 0.05 to 0.1 $\mu$m, in comparison with an average thickness of the transparent electrode parts 221 and 231 of about 0.1 to 0.13 $\mu$m.

As explained above, transparent electrode parts 221 and 231 having the edges 80*a,* 81*a,* 80*b,* 81*b* or similar can be formed, for example, by performing a laser ablation process on the transparent conductive film 50 covering the surface of the front glass substrate 21. This means that the areas of the transparent conductive film 50 to which a laser beam is applied are ablated by being heated to a high temperature, while those areas of the transparent conductive film 50 surrounding the ablated areas melt due to the high temperature, and curve upward as a result of surface tension. Therefore, appropriate adjustment of the strength of the laser beam (i.e setting at a strength slightly more than that required to ablate the transparent conductive film 50) enables this laser ablation process to be performed.

Figure 13:
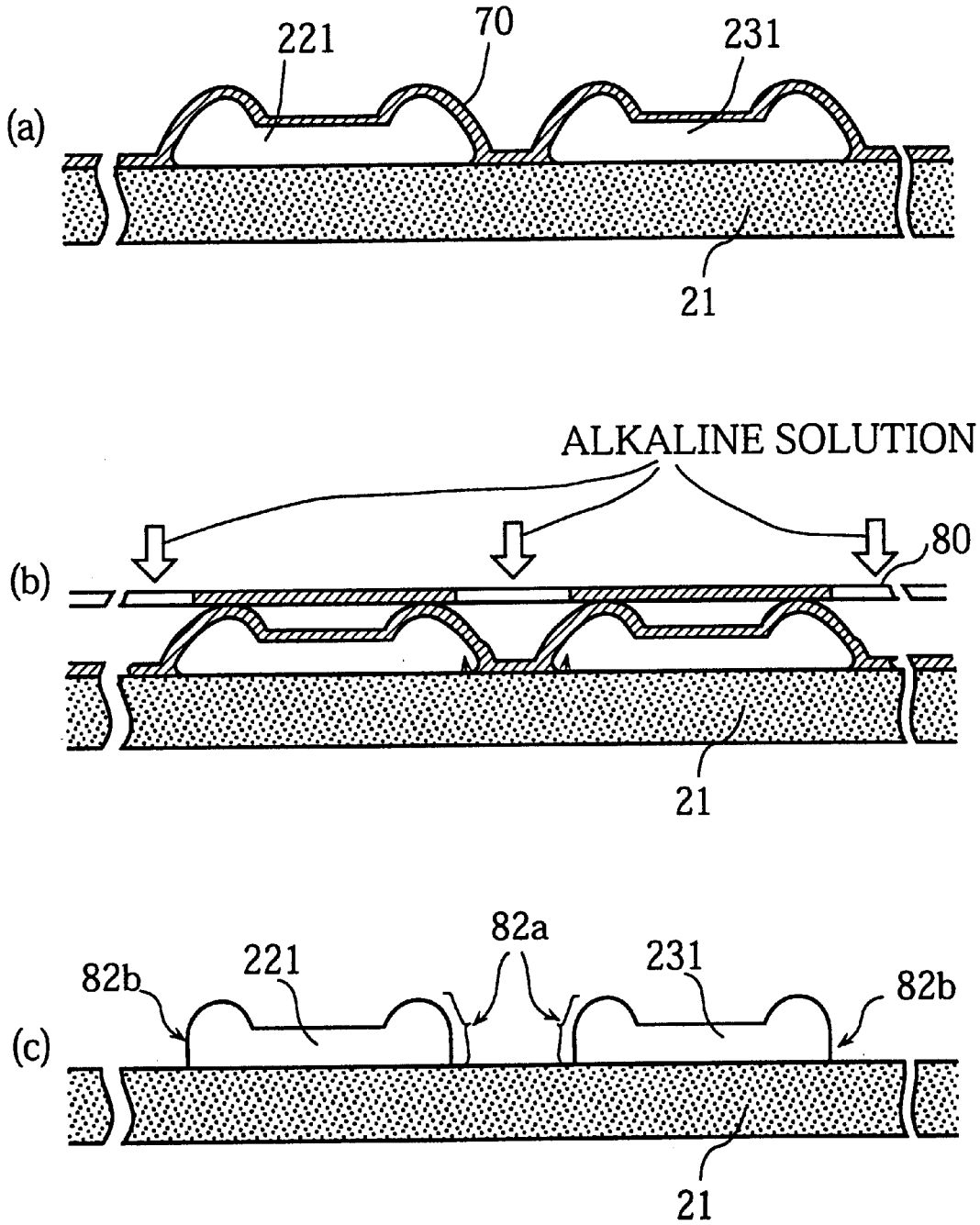
FIG. 13 is a partial cross-section of the front glass substrate 21 showing the manufacturing process for the edges 82*a* and 82*b;*

Here, the edges 82*a* and 82*b* shown in FIG. 12C can be formed using the method shown in FIG. 13. FIG. 13 shows an example of a method in which the edges 82*a* and 82*b* have been formed based on the edges 82*a* and 82*b*.

In this method, a photoresist 70 is applied to the surface of the front glass substrate 21 on which transparent electrode parts 221 and 231 having the edges 80*a* and 80*b* have been formed using laser ablation (FIG. 13A).

Next, a mask 80, having a certain pattern (here, a pattern that masks all of the surface apart from the gaps between the electrodes in each pair, and between pairs of neighboring electrodes) is fixed to the surface of the front glass substrate 21. Once the photoresist 70 has been developed, an alkaline solution is used to dispose of those parts of the photoresist 70 that were not masked (FIG. 13B).

Following this, the parts of the photoresist 70 which were not disposed of using the alkaline solution are washed off, thereby eliminating all of the photoresist 70 from the surface of the front glass substrate 21 (FIG. 13C).

In this way, transparent electrode parts 221 and 231 having the edges 82*a* and 82*b* shown in FIG. 12C are formed. This process is particularly effective when the transparent electrode parts 221 and 231 are formed in a precise shape (in other words cells are small) since it enables the edges of 82*a* and 82*b* to be formed cleanly.

Note, other edges apart from the edges 80*a* to 82*a,* and 80*b* to 82*b* may be manufactured using a laser process that combines first and second laser beams of different strengths (for example, the second laser beam may be slightly weaker than the first laser beam). Here, for example, basic manufacturing of each transparent electrode part 221 and 231 may be performed by the first laser beam, and then the second laser beam applied to parts of the transparent electrode parts 221 and 231, to complete their formation.

In addition, the edges 80*a* to 82*a,* and 80*b* to 82*b,* or similar need not be provided along both sides of the transparent electrode parts 221 and 231. Instead, it is sufficient for the edges 80*a* to 82*a* to be provided only along the sides of the pair of display electrodes 22 and 23 neighboring the gap 36.

Other Considerations

The embodiments describe an example using a YAG laser with a wavelength of 1.06 $\mu$m. However, another type of laser such as an excimer laser or a gas laser may be used. In addition, the wavelength of the laser need not be limited to 1.06 $\mu$m, and the laser may be set at other appropriate wavelengths, such as 0.53 $\mu$m, and 0.25 $\mu$m.

Furthermore, the part of the first embodiment describing the formation of the transparent electrode parts 221 and 231, discloses an example in which CVD or a similar method is used as a manufacturing method for the transparent conductive film 50, but another method such as sputtering or screen printing may be used as appropriate. The same applies to the method used to form the metal electrode parts 222 and 232.

In addition, instead of a $SnO_2$—$SbO_3$ material, the material used for the transparent conductive film 50 may be a $SnO_2$—F material, an $InGaZnO_4$ material, a $Cd_2SnO_4$ material, an $In_2O_3$—$SnO_3$ material, a $GaInO_3$ material, a ZnO—GeO material, or any other well known transparent material.

Furthermore, a silver material and a Cr—Cu—Cr material or similar are described as examples of materials used to formed the metal electrode parts 222 and 232, but other metal conductive materials may also be used. However, the effects obtained in the second embodiment are believed to be particularly marked when a silver material is used for the metal electrode parts 222 and 232.

Furthermore, pairs of display electrodes 22 and 23 are described in the embodiments and variations as being formed from the transparent electrode parts 221 and 231, and the metal electrode parts 222 and 232. However, the metal conductive film 60 may be formed directly over the entire surface of the front glass substrate 21 using sputtering, and then laser processed to form the metal electrode parts 222 and 232. In this case, each pair of display electrodes 22 and 23 is constructed from only the metal electrode parts 222 and 232 (in other words the display electrodes 22 and 23 do not have the transparent electrode parts 221 and 231).

In addition, the first embodiment gives an example in which the transparent conductive film 50 is formed on the front glass substrate 21, and then the transparent electrode parts 221 and 231 are formed, followed by the metal electrode parts 222 and 232. However, the transparent conductive film 50 and the metal conductive film 60 may be successively formed on the front glass substrate 21, and the metal electrode parts 222 and 232 formed by photolithography or similar, before the transparent electrode parts 221 and 231 are formed using laser ablation.

Furthermore, the embodiments describe examples in which a plurality of pairs of display electrodes 22 and 23 having protrusions are formed, and the variations of the embodiments an example in which a plurality of pairs of display electrodes 22 and 23 are formed using straight lines. However, the protrusions may be formed by performing laser ablation on the transparent electrode parts 221 and 231 by, for example, performing a pulse laser scan so that a plurality of elliptic laser spots are formed with parts of each laser spot overlapping slightly lengthwise. Furthermore, the shape of the display electrodes 22 and 23 need not be limited to one that has a protrusion, and may be changed to a shape that matches the appropriate cell size or similar. The shape of the laser head apertures should be changed to effect such a change in the shape of the plurality of pairs of display electrodes 22 and 23.

Here, if the shape of the laser spots is changed by changing the shape of the apertures 1031 and 1041 used in the embodiments, so that a rectangular laser spot is obtained, a wide variety of laser ablation processing can be performed by connecting a plurality of laser spots in the x and y directions.

Furthermore, an example in which cross-shaped reverse alignment marks 212 are formed along the length of the front glass substrate at the top and bottom during laser ablation of the transparent conductive film 50 is disclosed. However, the shape and position of these alignment marks 212 need not of course be limited to that explained, and appropriate changes may be made. In addition, the alignment marks 212 may be used either for alignment of the front glass substrate 21 with the back glass substrate 27, or for alignment of the transparent electrode parts 221 and 231 with the metal electrode parts 222 and 232.

Furthermore, an example in which the transparent conductive film is formed over the entire surface of the front glass substrate 21, and then processed using a laser to form the transparent electrode parts 221 and 231 is explained. Alternatively, areas such as the electrode extension forming areas that do not need to be covered by the transparent conductive film 50 may be masked, and the transparent conductive film 50 then formed using a method such as sputtering.

In addition, the embodiments concentrate on an example in which the transparent electrode parts 221 and 231 are formed using a laser ablation process, and the metal electrode parts 222 and 232 are formed using photolithography, and an example in which the transparent electrode parts 221 and 231 are formed using screen printing, and the metal electrode parts 222 and 232 are formed using a laser ablation process. However, the invention need not be limited to such manufacturing methods, provided that at least either the transparent electrode parts 221 and 231, or the metal electrode parts 222 and 232, are formed using laser ablation. Should the plurality of pairs of display electrodes 22 and 23 be formed from only the metal electrode parts 222 and 232, however, laser ablation must be performed.

The embodiments describe an example in which the laser torch 102 is provided with the first laser head 1030 and the second laser head 1040, and the first and second laser heads 1030 and 1040 perform simultaneous or successive laser ablation. However, the order in which the laser ablation is performed may be changed appropriately, insofar as it is possible (for example the process for manufacturing a-gap between a pair of display electrodes, and the process for manufacturing a gap between pairs of neighboring display electrodes may be interchanged).

The embodiments give specific examples such as the numerical values relating to the laser ablation process (laser spot size and amounts of movement in the x and y directions), but of course the invention need not be limited to such figures, and these may be changed as appropriate, in accordance, for example, with the size of the PDP that is to be manufactured.

Furthermore, when performing the laser ablation process, neighboring laser spots may overlap by a certain amount. This allows a single stroke in the laser ablation process to be performed without pause. However, in such a case the aperture and the shape of the laser spots need to be set with reference to the size of the overlapping laser spot portions.

The embodiments disclose an example in which two laser heads 1030 and 1040 perform laser ablation in parallel. However, the number of laser heads for emitting laser beams may be one, or three or more. If only one laser head is used, a plurality of apertures should be used interchangeably as appropriate. If a plurality of laser heads are used, these may be set to emit a plurality of laser beams each having different characteristics, such as laser spot shape, laser spot size, and laser strength. This enables formation of the plurality of pairs of display electrodes 22 and 23, and various repairs such as correction of line resistance, and fine shape adjustments to be made to the display electrodes 22 and 23 to be performed more speedily, and thus is desirable.

Industrial Applicability

The PDP manufacturing method of the invention enables at least some parts of the manufacturing process, such as photolithography, used conventionally to manufacture a plurality of pairs of display electrodes 22 and 23, to be replaced by a laser ablation process. Laser ablation requires fewer steps than photolithography, and these steps can be performed in a short time. As a result, the PDP manufacturing process can obtain a more satisfactory product yield, and contribute to a reduction in product costs.

Furthermore, the laser ablation process generates much less exhaust gas and waste solution than photolithography. Therefore, generation of used photoresist and waste solution from etching or similar is restricted, making the method an effective anti-pollution measure.

The PDP in the present invention is provided with alignment marks on the front glass substrate for alignment of the plates, and of the transparent and metal electrode parts. This ensures that the front and back glass substrates, and the transparent and metal electrodes are precisely aligned, making full use of the fundamental design characteristics of the PDP.

What is claimed is:

1. A surface discharge AC plasma display panel manufacturing method comprising a display electrode forming step of forming a plurality of pairs of display electrodes in parallel lines on a main surface of a first plate, and a plate sealing step of aligning the main surface of the first plate with a main surface of a second plate, and sealing the first and second plates together, and in the display electrode forming step, (1) the plurality of pairs of display electrodes are formed by (a) coating the main surface of the first plate with a transparent conductive film, and vaporizing parts of the transparent conductive film using laser ablation to form transparent electrode parts from remaining parts of the transparent conductive film, and (b) coating at least surfaces of the transparent electrode parts with the metal electrode material to form metal electrode parts that are in electrical contact with the transparent electrode parts, and (2) a dielectric layer is formed so as to embed the transparent electrode parts and the metal electrode parts.

2. The surface discharge AC plasma display panel manufacturing method of claim 1, wherein in the display electrode forming step, the plurality of pairs of display electrodes are formed by (1) performing laser ablation to vaporize parts of the transparent conductive film to form transparent electrode parts and alignment marks, and (2) coating at least surfaces of the transparent electrode parts with metal electrode material to form metal electrode parts, the alignment marks being used to align the metal electrode material with the transparent electrode parts.

3. The surface discharge AC plasma display panel manufacturing method of claim 1, wherein in the display electrode forming step, the main surface of the first plate is coated with the transparent conductive film, and laser ablation is performed so as to avoid processing transparent conductive film coating one or more outer areas of the main surface.

4. A surface discharge AC plasma display panel manufacturing method comprising a display electrode forming step of forming a plurality of pairs of display electrodes in parallel lines on a main-surface of a first plate, and a plate sealing step of aligning the main surface of the first plate with a main surface of a second plate, and sealing the first and second plates together, wherein in the display electrode forming step, (1) the plurality of pairs of display electrodes are formed by (a) coating the main surface of the first plate with transparent conductive film, (b) coating metal electrode material over the transparent conductive film to form metal electrode parts, and (c) performing laser ablation to vaporize parts of the transparent conductive film to form transparent electrode parts that are remaining parts of the transparent conductive film, and (2) a dielectric layer is formed so as to embed the transparent electrode parts and the metal electrode parts.

5. The surface discharge AC plasma display panel manufacturing method of claim 4, wherein in the display electrode forming step, the plurality of pairs of display electrodes are formed by (1) successively coating the main surface of the first plate with the transparent conductive film and the metal electrode material, and (2) successively performing laser ablation to vaporize parts of the transparent conductive film and the metal electrode material to form the transparent and metal electrode parts.

6. A surface discharge AC plasma display panel manufacturing method comprising a display electrode forming step of forming a plurality of pairs of display electrodes in parallel lines on a main surface of a first plate, and a plate sealing step of aligning the main surface of the first plate with a main surface of a second plate, and sealing the first and second plates together, wherein in the display electrode forming step, a metal material is used as the display electrode material and the plurality of pairs of display electrodes are formed by (1) coating the main surface of the first plate with the metal material, and (2) performing laser ablation to parts of the metal material, remaining parts of the metal material forming the display electrodes.

7. A surface discharge AC plasma display panel manufacturing method comprising a display electrode forming step of forming a plurality of pairs of display electrodes in parallel lines on a main surface of a first plate, and a plate sealing step of aligning the main surface of the first plate with a main surface of a second plate, and sealing the first and second plates together, wherein in the display electrode forming step, the plurality of pairs of display electrodes and alignment marks are formed together on the main surface of the first plate by performing laser ablation to vaporize parts of the display electrode material, remaining parts of the display electrode material forming the display electrodes, and in the plate sealing step, the first and second plates are sealed together by using the alignment marks to align the main surface of the first plate with the main surface of the second plate.

8. The surface discharge AC plasma display panel manufacturing method of claim 7, wherein in the display electrode forming step, reverse alignment marks are formed by performing laser ablation to vaporize parts of the display electrode material coating the main surface of the first plate.

9. The surface discharge AC plasma display panel manufacturing method of claim 8, wherein in the display electrode forming step, the reverse alignment marks are each formed in a cross shape.

10. A surface discharge AC plasma display panel manufacturing method comprising a display electrode forming step of forming a plurality of pairs of display electrodes in parallel lines on a main surface of a first plate, and a plate sealing step of aligning the main surface of the first plate with a main surface of a second plate, and sealing the first and second plates together, wherein: in the display electrode forming step, the plurality of pairs of display electrodes, alignment marks and a plurality of electrode extension forming areas are formed by (1) coating the main surface of the first plate with display electrode material, and (2) performing laser ablation to vaporize parts of the display electrode material, the plurality of electrode extension areas being formed near either end of the plurality of pairs of display electrodes, and in the plate sealing step, the first and second plates are sealed together using the alignment marks to align the main surface of the first plate with the main surface of the second plate.

11. A surface discharge AC plasma display panel manufacturing method comprising a display electrode forming step of forming a plurality of pairs of display electrodes in parallel lines on a main surface of a first plate, and a plate sealing step of aligning the main surface of the first plate with a main surface of a second plate, and sealing the first and second plates together, wherein in the display electrode forming step, the plurality of pairs of display electrodes are formed by (1) coating one or more areas on the main surface of the first plate with the display electrode material, the one or-more areas being smaller than a total area of the main surface, and at least as long as the display electrodes, and (2) performing laser ablation to vaporize parts of the display electrode material, remaining parts of the display electrode material forming the display electrodes.

12. The surface discharge AC plasma display panel manufacturing method of claim 11, wherein in the display electrode forming step, the plurality of pairs of display electrodes are formed by (1) masking one or more areas of the main surface of the first plate that are not used to form the plurality of pairs of display electrodes, (2) substantially coating the display electrode material on one or more areas of the main surface that is used to form the plurality of pairs of display electrodes, and (3) performing laser ablation to vaporize parts of the display electrode material.

13. The surface discharge AC plasma display panel manufacturing method of claim 12, wherein in the display electrode forming step, the plurality of pairs of display electrodes and the alignment marks are formed by (1) masking one or more areas of the main surface of the first plate that are not used to form the plurality of pairs of display electrodes and the alignment marks, (2) substantially coating areas of the main surface that are used to form the plurality of pairs of display electrodes and the alignment marks with the display electrode material, and (3) performing laser ablation to vaporize parts of the display electrode material.

14. A surface discharge AC plasma display panel manufacturing method comprising a display electrode forming step of forming a plurality of pairs of display electrodes in parallel lines on a main surface of a first plate, and a plate sealing step for aligning the main surface of the first plate with a main surface of a second plate on which a plurality of address electrodes have been arranged in parallel lines, so that the plurality of pairs of display electrodes intersect with the address electrodes, and sealing the first and second plates together, the plurality of pairs of display electrodes being formed in the display electrode forming step by (1) coating the main surface of the first plate with display electrode material, and (2) performing laser ablation to vaporize parts of the display electrode material by applying a first laser beam and a second laser beam in parallel to the display electrode material, the remaining parts of the display electrode material forming the display electrodes.

15. The surface discharge AC plasma display panel manufacturing method of claim 14, wherein in the display electrode forming step, the plurality of pairs of display electrodes are formed by (1) coating the main surface of the first plate with the display electrode material, and (2) applying a laser beam having a first spot shape and a laser beam having a second spot shape different from the first spot shape to the display electrode material.

16. The surface discharge AC plasma display panel of claim 15, wherein in the display electrode forming step, the main surface of the first plate is coated with the display electrode material, and the plurality of pairs of display electrodes are formed so that each area at which a pair of display electrodes intersect with an address electrode has a display electrode pattern of a same size and shape.

17. The surface discharge AC plasma display panel of claim 15, wherein in the display electrode forming step, the laser beam having the first laser spot shape and the laser beam having the second laser spot shape are differently sized rectangles whose width is orthogonal to a laser beam scanning direction.

18. The surface discharge AC plasma display panel manufacturing method of claim 14, wherein in the display electrode forming step, gaps between a pair of display electrodes are formed by applying the laser beam having the first laser spot shape to the display electrode material, and gaps between neighboring pairs of display electrodes are formed by applying the laser beam having the second laser spot shape to the display electrode material.

19. A surface discharge AC plasma display panel manufacturing method comprising a display electrode forming step of forming a plurality of pairs of display electrodes in parallel lines on a main surface of a first plate, and a plate sealing step of aligning the main surface of the first plate with a main surface of a second plate on which a plurality of address electrodes and a plurality of barrier ribs have been arranged in parallel lines and sealing the first and second plates together, wherein in the display electrode forming step, the display electrode material consists of transparent conductive film and metal electrode material, and (1) a plurality of transparent electrode parts are formed on the main surface of the first plate, (2) the main surface of the first plate including the transparent electrode parts is coated with the metal electrode material, (3) metal electrode parts are formed by applying a first laser beam to the metal electrode material, and (4) resistance values of the metal electrode parts are adjusted by annealing performed using a second laser beam.

20. A surface discharge AC plasma display panel formed by aligning a main surface of a first plate with a main surface of a second plate, and sealing the first and second plates together, a plurality of pairs of display electrodes having been formed in parallel lines on the main surface of the first plate, each pair of display electrodes being formed from a transparent electrode part and a metal electrode part that are in electrical contact, wherein alignment marks for performing alignment of the transparent electrode parts and the metal electrode parts are formed on the main surface of the first plate, the transparent and metal electrode parts having been formed by laser ablation.

21. A surface discharge AC plasma display panel formed by aligning a main surface of a first plate, on which a plurality of pairs of display electrodes having transparent electrode parts have been formed in parallel lines, with a main surface of a second plate, wherein a cross-section across a width of the transparent electrode parts is shaped so that an edge of each transparent electrode bordering a gap between a pair of display electrodes and facing the second plate is rounded by performing laser ablation.

22. The surface discharge AC plasma display panel of claim 21, wherein the cross-section across the width of each of the transparent electrode parts is shaped so that an edge of each transparent electrode part bordering a gap between a pair of electrodes and facing the second plate is rounded, and curved so as to protrude upward more than the center of the transparent electrode parts.

23. A surface discharge AC plasma display panel formed by aligning a first plate, on which a plurality of pairs of display electrodes having transparent electrode parts have been formed in parallel lines, with a main surface of a second plate, wherein a cross-section across the width of the transparent electrode parts is shaped so that both edges of the transparent electrode parts facing the second plate are rounded by performing laser ablation.

24. The surface discharge AC plasma display panel of claim 23, wherein the cross-section across the width of the transparent electrode parts is shaped so that both edges of the transparent electrode parts facing the second plate are rounded, and curve upward more than the center of the transparent electrode parts.

* * * * *

UNITED STATES PATENT AND TRADEMARK OFFICE

CERTIFICATE OF CORRECTION

PATENT NO. : 6,433,489 B1
DATED : August 13, 2002
INVENTOR(S) : Hiroyoshi Tanaka et al.

It is certified that error appears in the above-identified patent and that said Letters Patent is hereby corrected as shown below:

Column 24,
Line 19, before “parts” insert -- vaporize --.

Signed and Sealed this

Twentieth Day of May, 2003

JAMES E. ROGAN
*Director of the United States Patent and Trademark Office*